US009462392B2

(12) United States Patent
Tagami et al.

(10) Patent No.: US 9,462,392 B2
(45) **Date of Patent: *Oct. 4, 2016**

(54) SPEAKER DEVICE WITH A MAGNETIC GAP FILLED WITH MAGNETIC FLUID AND CHANGING MAGNETIC FLUX DENSITY IN AXIAL AND CIRCUMFERENTIAL DIRECTIONS

(71) Applicant: Sony Corporation, Tokyo (JP)

(72) Inventors: Takahisa Tagami, Kanagawa (JP); Emiko Ikeda, Tokyo (JP); Keisuke Nakashita, Tokyo (JP)

(73) Assignee: SONY CORPORATION, Tokyo (JP)

( * ) Notice: Subject to any disclaimer, the term of this patent is extended or adjusted under 35 U.S.C. 154(b) by 183 days.

This patent is subject to a terminal disclaimer.

(21) Appl. No.: 14/319,753

(22) Filed: Jun. 30, 2014

(65) Prior Publication Data

US 2014/0314267 A1 Oct. 23, 2014

Related U.S. Application Data

(63) Continuation of application No. 13/568,755, filed on Aug. 7, 2012, now Pat. No. 8,798,309.

(30) Foreign Application Priority Data

Aug. 22, 2011 (JP) ..... 2011-080875

(51) Int. Cl.
*H04R 1/00* (2006.01)
*H04R 9/06* (2006.01)
(Continued)

(52) U.S. Cl.
CPC ..... *H04R 15/00* (2013.01); *H04R 1/06* (2013.01); *H04R 9/027* (2013.01)

(58) Field of Classification Search
CPC ..... H04R 9/027
USPC ..... 381/412, 414, 415, 419, 420
See application file for complete search history.

(56) References Cited

U.S. PATENT DOCUMENTS 3,819,876 A 6/1974 Kinoshita
8,798,309 B2 * 8/2014 Tagami ..... H04R 9/027 381/414

(Continued)

FOREIGN PATENT DOCUMENTS

EP 1 613 126 A2 1/2006
JP 55-135594 U 9/1980

(Continued)

OTHER PUBLICATIONS

Extended Search Report issued Oct. 31, 2012 in European Patent Application No. 12180084.1-2225.

(Continued)

*Primary Examiner* — Rasha Al Aubaidi
*Assistant Examiner* — Katherine Faley
(74) *Attorney, Agent, or Firm* — Oblon, McClelland, Maier & Neustadt, L.L.P.

(57) ABSTRACT

A speaker device including a magnet formed in a ring shape; a yoke having a center pole portion inserted in the center of the magnet; a plate formed in a ring shape and arranged on an outer circumferential surface of the center pole portion of the yoke while being attached to the magnet; a coil bobbin formed in a cylindrical shape and movable in the axial direction of the center pole portion while being partially fitted on the center pole portion of the yoke; a voice coil wrapped around the outer circumferential surface of the coil bobbin, at least part of the voice coil being arranged in a magnetic gap formed between the plate and the center pole portion of the yoke; a diaphragm having its inner circumferential portion connected to the coil bobbin; and a magnetic fluid filled in the magnetic gap.

12 Claims, 20 Drawing Sheets

(51) Int. Cl.

| | |
|---|---|
| ***H04R 11/02*** | (2006.01) |
| ***H04R 15/00*** | (2006.01) |
| ***H04R 9/02*** | (2006.01) |
| ***H04R 1/06*** | (2006.01) |

(56) References Cited

U.S. PATENT DOCUMENTS

| | | | | |
|---|---|---|---|---|
| 2004/0071308 | A1* | 4/2004 | Guenther | H04R 11/02 381/409 |
| 2005/0047626 | A1 | 3/2005 | Barnes | |
| 2005/0281432 | A1 | 12/2005 | Horigome | |
| 2007/0237353 | A1* | 10/2007 | Stiles | H04R 9/06 381/418 |

FOREIGN PATENT DOCUMENTS

| | | | |
|---|---|---|---|
| JP | 59-152797 | | 8/1984 |
| JP | 62-186594 | | 11/1987 |
| JP | 6-14394 | | 1/1994 |
| JP | 7-39197 | | 7/1995 |
| JP | 8-79886 | A | 3/1996 |
| JP | 2002-142291 | A | 5/2002 |
| JP | 2003-274485 | | 9/2003 |
| JP | 2010-50764 | | 3/2010 |
| WO | WO 2009/016743 | A1 | 2/2009 |

OTHER PUBLICATIONS

Machine Translation of Japanese Publication 6-14394.

Ferro Tec, APG O Series Audio Fferofluid, Jan. 12, 2011.

Office Action issued Feb. 17, 2015 in Japanese Patent Application No. 2011-180875 (with English language translation).

* cited by examiner (PRESENT TECHNOLOGY)

(PRESENT TECHNOLOGY)

SPEAKER DEVICE WITH A MAGNETIC GAP FILLED WITH MAGNETIC FLUID AND CHANGING MAGNETIC FLUX DENSITY IN AXIAL AND CIRCUMFERENTIAL DIRECTIONS

CROSS-REFERENCE TO RELATED APPLICATIONS

This application is a continuation of U.S. application Ser. No. 13/568,755, filed Aug. 7, 2012, which claims the benefit of priority under 35 U.S.C. §119 of Japanese Application No. 2011-180875, filed Aug. 22, 2011. The entire contents of each of which are incorporated herein by reference.

BACKGROUND

The present technology relates to a technical field for a speaker device, and more particularly, to a technical field for providing improved acoustic conversion efficiency and improved sound quality by inhibiting a magnetic fluid filled in a magnetic gap from flying off.

Some speaker devices have a ring-shaped magnet, a yoke having a center pole portion and a plate formed with a magnetic material. A voice coil wrapped around a coil bobbin is held in a magnetic gap formed between the center pole portion and plate. In such a speaker device, when a current is passed through the voice coil, the coil bobbin moves in the axial direction of the center pole portion, thus producing a sound.

Further, some of the above speaker devices have an elastic damper formed in a ring shape. The inner circumferential portion of the damper is connected to the outer circumferential surface of the coil bobbin, with the outer circumferential portion of the damper connected to the frame serving as an enclosure. The damper has the capability of holding the voice coil in a magnetic gap without the same coil touching the plate when the coil bobbin moves.

However, the damper accounts for a certain percentage of the total weight of the speaker device. Therefore, the speaker device is heavy because of the damper, thus inhibiting the movement of the coil bobbin and resulting in reduced acoustic conversion efficiency. The damper accounts, for example, for about 15% to 20% of the total weight of the speaker device.

For this reason, a magnetic fluid is filled in a given portion of some speaker devices rather than using a damper, thus reducing the weight of the speaker device and providing improved acoustic conversion efficiency (refer, for example, to Japanese Patent Laid-Open Nos. 1996-79886 (Patent Document 1) and 2003-32791 (Patent Document 2)).

In the speaker device described in Patent Document 1, a magnetic fluid is filled in a magnetic gap formed between the center pole portion and plate, and a voice coil wrapped around a coil bobbin is held in the same magnetic gap.

In the speaker device described in Patent Document 2, a shaft is attached to a center cap arranged on the tip side of the coil bobbin. The tip of the shaft is inserted into a through hole formed in the center pole portion via a bushing with a magnetic fluid filled between the shaft and bushing. The magnetic fluid is filled where the magnetic flux density is maximum in the center pole portion.

SUMMARY

In the speaker device described in Patent Document 1, however, the voice coil is held in the magnetic gap with the magnetic fluid filled in the magnetic gap. As a result, when the coil bobbin moves, the magnetic fluid flies off from the magnetic gap, thus leading to a reduced amount of the magnetic fluid filled in the magnetic gap and hindering the stable production of a sound.

Further, in the speaker device described in Patent Document 1, the magnetic flux is agitated during the movement of the coil bobbin, possibly producing an abnormal noise and resulting in poor sound quality.

In the speaker device described in Patent Document 2, on the other hand, the magnetic fluid does not readily fly off from the magnetic gap during the movement of the coil bobbin because the magnetic fluid is filled where the magnetic flux density is maximum in the center pole portion.

However, because a shaft is provided, the speaker device is heavy, thus inhibiting the movement of the coil bobbin and resulting in reduced acoustic conversion efficiency.

Further, the magnetic fluid is agitated as a result of the movement of the shaft during the movement of the coil bobbin, possibly producing an abnormal noise. This may lead to distortion in the output sound, thus resulting in reduced sound quality.

In light of the foregoing, it is desirable to surmount the above problems and provide improved acoustic conversion efficiency and improved sound quality.

Firstly, according to an embodiment of the present technology, there is provided a speaker device that includes a magnet, yoke, plate, coil bobbin, voice coil, diaphragm and magnetic fluid. The magnet is formed in a ring shape. The yoke has a center pole portion inserted in the center of the magnet. The plate is formed in a ring shape and arranged on the outer circumferential surface of the center pole portion of the yoke while being attached to the magnet. The coil bobbin is formed in a cylindrical shape and movable in the axial direction of the center pole portion while being partially fitted on the center pole portion of the yoke. The voice coil is wrapped around the outer circumferential surface of the coil bobbin, and at least part of the same coil is arranged in a magnetic gap formed between the plate and the center pole portion of the yoke. The diaphragm has its inner circumferential portion connected to the coil bobbin and is vibrated as the coil bobbin moves. The magnetic fluid is filled in the magnetic gap. A magnetic gradient is formed that is adapted to change the magnetic force acting on the magnetic fluid by changing the magnetic flux density in the circumferential direction of the center pole portion.

In the speaker device, therefore, the magnetic fluid attempting to fly off from the magnetic gap is attracted by the magnetic force in the area where the magnetic gradient is formed.

Secondly, in the speaker device, it is preferred that a magnetic gradient should be formed that is adapted to change the magnetic force acting on the magnetic fluid by changing the magnetic flux density in the axial direction of the center pole portion.

If a magnetic gradient is formed that is adapted to change the magnetic force acting on the magnetic fluid by changing the magnetic flux density in the axial direction of the center pole portion, this ensures that the magnetic fluid attempting to fly off from the magnetic gap is attracted by the magnetic force in the area where the magnetic gradient is formed.

Thirdly, in the speaker device, it is preferred that the lowest magnetic flux density in the circumferential direction should be greater than half the highest magnetic flux density in the axial direction.

If the lowest magnetic flux density in the circumferential direction is greater than half the highest magnetic flux density in the axial direction, this ensures that the magnetic fluid attempting to fly off from the magnetic gap is readily attracted in the circumferential direction by the magnetic force in the area where the magnetic gradient is formed.

Fourthly, in the speaker device, it is preferred that the saturated magnetic flux of the magnetic fluid should be 30 mT to 40 mT, and that the viscosity thereof should be 300 cp or less.

If the saturated magnetic flux of the magnetic fluid is 30 mT to 40 mT, and if the viscosity thereof is 300 cp or less, this prevents the magnetic fluid from flying off and ensures that the movement of the coil bobbin is not readily inhibited by the magnetic fluid.

Fifthly, in the speaker device, it is preferred that a magnetic flux change section adapted to form a magnetic gradient in the circumferential direction of the center pole portion should be provided on the inner circumferential surface of the plate or the outer circumferential surface of the center pole portion.

If the magnetic flux change section adapted to form a magnetic gradient in the circumferential direction of the center pole portion is provided on the inner circumferential surface of the plate or the outer circumferential surface of the center pole portion, this makes it easy to form a magnetic gradient in a magnetic gap.

Sixthly, in the speaker device, it is preferred that the plurality of magnetic flux change sections should be provided to be spaced equidistantly from each other in the circumferential direction.

If the plurality of magnetic flux change sections are provided to be spaced equidistantly from each other in the circumferential direction, this ensures symmetry between the same sections.

Seventhly, in the speaker device, it is preferred that a concave portion extending in the axial direction should be formed as the magnetic flux change section.

If a concave portion extending in the axial direction is formed as the magnetic flux change section, this makes it easy to form the magnetic flux change section.

Eighthly, in the speaker device, it is preferred that the magnetic flux change section adapted to form a magnetic gradient in the circumferential direction of the center pole portion should be provided on each of the inner circumferential surface of the plate and the outer circumferential surface of the center pole portion.

If the magnetic flux change section adapted to form a magnetic gradient in the circumferential direction of the center pole portion is provided on each of the inner circumferential surface of the plate and the outer circumferential surface of the center pole portion, this makes it easy to form a magnetic gradient in a magnetic gap while at the same time ensuring a higher degree of freedom in changing the magnetic flux density.

Ninthly, in the speaker device, it is preferred that the plurality of magnetic flux change sections should be provided to be spaced equidistantly from each other in the circumferential direction.

If the plurality of magnetic flux change sections are provided to be spaced equidistantly from each other in the circumferential direction, this ensures symmetry between the same sections.

Tenthly, in the speaker device, it is preferred that the plurality of magnetic flux change sections provided on the inner circumferential surface of the plate and the plurality of magnetic flux change sections provided on the outer circumferential surface of the center pole portion should alternate in the circumferential direction.

If the plurality of magnetic flux change sections provided on the inner circumferential surface of the plate and the plurality of magnetic flux change sections provided on the outer circumferential surface of the center pole portion alternate in the circumferential direction, this ensures symmetry between the same sections.

Eleventhly, in the speaker device, it is preferred that a concave portion extending in the axial direction should be formed as the magnetic flux change section.

If a concave portion extending in the axial direction is formed as the magnetic flux change section, this makes it easy to form the magnetic flux change section.

Twelfthly, in the speaker device, it is preferred that a magnetic flux change section adapted to form a magnetic gradient in the axial direction of the center pole portion should be provided on the plate or center pole portion.

If the magnetic flux change section adapted to form a magnetic gradient in the axial direction of the center pole portion is provided on the plate or center pole portion, this makes it easy to form a magnetic gradient in the center pole portion.

Thirteenthly, in the speaker device, it is preferred that the tip of the center pole portion protruding in the axial direction from the plate should be provided as the magnetic flux change section.

If the tip of the center pole portion protruding in the axial direction from the plate is provided as the magnetic flux change section, this provides a simpler configuration of the magnetic flux change section.

Fourteenthly, in the speaker device, it is preferred that a sloping surface sloping with respect to the axial direction should be formed on the surface of the plate or center pole portion so that the area where the sloping surface is formed is provided as the magnetic flux change section.

If a sloping surface sloping with respect to the axial direction is formed on the surface of the plate or center pole portion so that the area where the sloping surface is formed is provided as the magnetic flux change section, this makes it easy to work on the magnetic flux change section.

Fifteenthly, in the speaker device, it is preferred that a curved surface should be formed on the surface of the plate or center pole portion so that the area where the curved surface is formed is provided as the magnetic flux change section.

If a curved surface is formed on the surface of the plate or center pole portion so that the area where the curved surface is formed is provided as the magnetic flux change section, this ensures a higher degree of freedom in changing the magnetic flux density.

Sixteenthly, in the speaker device, it is preferred that the magnetic flux change section adapted to form a magnetic gradient in the axial direction of the center pole portion should be provided on each of the plate and center pole portion.

If the magnetic flux change section adapted to form a magnetic gradient in the axial direction of the center pole portion is provided on each of the plate and center pole portion, this makes it easy to form a magnetic gradient in the axial direction of the center pole portion while at the same time ensuring a higher degree of freedom in changing the magnetic flux density.

Seventeenthly, in the speaker device, it is preferred that a sloping surface sloping with respect to the axial direction should be formed on the surface of each of the plate and center pole portion so that each of the areas where the sloping surface is formed is provided as the magnetic flux change section.

If a sloping surface sloping with respect to the axial direction is formed on the surface of each of the plate and center pole portion so that each of the areas where the sloping surface is formed is provided as the magnetic flux change section, this makes it easy to work on the magnetic flux change section while at the same time ensuring a higher degree of freedom in changing the magnetic flux density.

Eighteenthly, in the speaker device, it is preferred that a curved surface should be formed on the surface of each of the plate and center pole portion so that each of the areas where the curved surface is formed is provided as the magnetic flux change section.

If a curved surface is formed on the surface of each of the plate and center pole portion so that each of the areas where the curved surface is formed is provided as the magnetic flux change section, this ensures a higher degree of freedom in changing the magnetic flux density.

Nineteenthly, in the speaker device, it is preferred that a plurality of leads should be provided for connection to the voice coil, and that the plurality of leads should be arranged symmetrically with respect to the central axis of the coil bobbin.

If a plurality of leads are provided for connection to the voice coil, and if the plurality of leads are arranged symmetrically with respect to the central axis of the coil bobbin, this inhibits the rolling phenomenon of the coil bobbin.

Twentiethly, in the speaker device, it is preferred that a plurality of leads should be provided for connection to the voice coil, and that at least one connecting wire should be provided for connection to the coil bobbin, and that the plurality of leads and connecting wire should be arranged symmetrically with respect to the central axis of the coil bobbin.

If a plurality of leads are provided for connection to the voice coil, if at least one connecting wire is provided for connection to the coil bobbin, and if the plurality of leads and connecting wire are arranged symmetrically with respect to the central axis of the coil bobbin, this prevents the rolling phenomenon of the coil bobbin.

The speaker device according to the present technology includes a magnet, yoke, plate, coil bobbin, voice coil, diaphragm and magnetic fluid. The magnet is formed in a ring shape. The yoke has a center pole portion inserted in the center of the magnet. The plate is formed in a ring shape and arranged on the outer circumferential surface of the center pole portion of the yoke while being attached to the magnet. The coil bobbin is formed in a cylindrical shape and movable in the axial direction of the center pole portion while being partially fitted on the center pole portion of the yoke. The voice coil is wrapped around the outer circumferential surface of the coil bobbin, and at least part of the same coil is arranged in a magnetic gap formed between the plate and the center pole portion of the yoke. The diaphragm has its inner circumferential portion connected to the coil bobbin and is vibrated as the coil bobbin moves. The magnetic fluid is filled in the magnetic gap. A magnetic gradient is formed that is adapted to change the magnetic force acting on the magnetic fluid by changing the magnetic flux density in the circumferential direction of the center pole portion.

Therefore, the magnetic fluid does not fly off from the magnetic gap during the movement of the coil bobbin, and the amount of the magnetic fluid filled in the magnetic gap does not decline. Further, the magnetic fluid is not agitated. This contributes to improved acoustic conversion efficiency and improved sound quality.

In an embodiment of the present technology, a magnetic gradient is formed that is adapted to change the magnetic force acting on the magnetic fluid by changing the magnetic flux density in the circumferential direction of the center pole portion.

This contributes to further improved acoustic conversion efficiency and further improved sound quality.

In another embodiment of the present technology, the lowest magnetic flux density in the circumferential direction is greater than half the highest magnetic flux density in the axial direction.

This ensures that the magnetic fluid attempting to fly off from the magnetic gap is positively kept in the magnetic gap during the movement of the coil bobbin, positively preventing the magnetic fluid from flying off.

In still another embodiment of the present technology, the saturated magnetic flux of the magnetic fluid is 30 mT to 40 mT, and the viscosity thereof is 300 cp or less.

This prevents the magnetic fluid from flying off and ensures that the movement of the coil bobbin is not readily inhibited by the magnetic fluid, thus providing an excellent reproduced sound output from the speaker device.

In still another embodiment of the present technology, the magnetic flux change section adapted to form a magnetic gradient in the circumferential direction of the center pole portion is provided on the inner circumferential surface of the plate or the outer circumferential surface of the center pole portion.

This ensures that the plate and center pole portion are not complicated in structure, thus contributing to improved acoustic conversion efficiency and improved sound quality in addition to achieving simplification in structure.

In still another embodiment of the present technology, the plurality of magnetic flux change sections are provided to be spaced equidistantly from each other in the circumferential direction.

This provides an excellent magnetic balance thanks to the symmetrical arrangement of the magnetic flux change sections, thus allowing for smooth movement of the coil bobbin.

In still another embodiment of the present technology, a concave portion extending in the axial direction is formed as the magnetic flux change section.

This makes it easy to form the magnetic flux change section and keeps the outer diameter of the speaker device unchanged, thus contributing to downsizing of the speaker device.

In still another embodiment of the present technology, the magnetic flux change section adapted to form a magnetic gradient in the circumferential direction of the center pole portion is provided on each of the inner circumferential surface of the plate and the outer circumferential surface of the center pole portion.

This ensures a higher degree of freedom in changing the magnetic flux density, thus contributing to improved degree of freedom in design.

In still another embodiment of the present technology, the plurality of magnetic flux change sections are provided to be spaced equidistantly from each other in the circumferential direction.

This provides an excellent magnetic balance thanks to the symmetrical arrangement of the magnetic flux change sections, thus allowing for smooth movement of the coil bobbin.

In still another embodiment of the present technology, the plurality of magnetic flux change sections provided on the inner circumferential surface of the plate and the plurality of magnetic flux change sections provided on the outer circumferential surface of the center pole portion alternate in the circumferential direction.

This provides an excellent magnetic balance thanks to the symmetrical arrangement of the magnetic flux change sections, thus allowing for smooth movement of the coil bobbin.

In still another embodiment of the present technology, a concave portion extending in the axial direction is formed as the magnetic flux change section.

This makes it easy to form the magnetic flux change section and keeps the outer diameter of the speaker device unchanged, thus contributing to downsizing of the speaker device.

In still another embodiment of the present technology, the magnetic flux change section adapted to form a magnetic gradient in the axial direction of the center pole portion is provided on the plate or center pole portion.

This ensures that the plate or center pole portion is not complicated in structure, thus contributing to improved acoustic conversion efficiency and improved sound quality in addition to achieving simplification in structure.

In still another embodiment of the present technology, the tip of the center pole portion protruding in the axial direction from the plate is provided as the magnetic flux change section.

This makes it easy to provide the magnetic flux change section.

In still another embodiment of the present technology, a sloping surface sloping with respect to the axial direction is formed on the surface of the plate or center pole portion so that the area where the sloping surface is formed is provided as the magnetic flux change section.

This makes it easy to work on the magnetic flux change section, thus allowing formation of a magnetic gradient with ease.

In still another embodiment of the present technology, a curved surface is formed on the surface of the plate or center pole portion so that the area where the curved surface is formed is provided as the magnetic flux change section.

This makes it easy to form a desired magnetic gradient.

In still another embodiment of the present technology, the magnetic flux change section adapted to form a magnetic gradient in the axial direction of the center pole portion is provided on each of the plate and center pole portion.

This ensures a higher degree of freedom in changing the magnetic flux density, thus contributing to improved degree of freedom in design.

In still another embodiment of the present technology, a sloping surface sloping with respect to the axial direction is formed on the surface of each of the plate and center pole portion so that each of the areas where the sloping surface is formed is provided as the magnetic flux change section.

This makes it easy to work on the magnetic flux change section, thus allowing formation of a magnetic gradient with ease.

In still another embodiment of the present technology, a curved surface is formed on the surface of each of the plate and center pole portion so that each of the areas where the curved surface is formed is provided as the magnetic flux change section.

This makes it easy to form a desired magnetic gradient.

In still another embodiment of the present technology, a plurality of leads are provided for connection to the voice coil, and the plurality of leads are arranged symmetrically with respect to the central axis of the coil bobbin.

This inhibits the rolling phenomenon of the coil bobbin, thus contributing to improved quality of the output sound.

In still another embodiment of the present technology, a plurality of leads are provided for connection to the voice coil. Further, at least one connecting wire is provided for connection to the coil bobbin. Still further, the plurality of leads and connecting wire are arranged symmetrically with respect to the central axis of the coil bobbin.

This prevents the rolling phenomenon of the coil bobbin, thus contributing to further improved quality of the output sound.

DETAILED DESCRIPTION OF THE PREFERRED EMBODIMENT

A description will be given below of the preferred embodiment of the speaker device according to the present technology with reference to the accompanying drawings.

In the description given below, the vertical, longitudinal and horizontal directions are shown assuming that the speaker device faces forward.

It should be noted that the vertical, longitudinal and horizontal directions are shown for reasons of convenience, and that the present technology is not limited to these directions.

[Overall Configuration]

Figure 1:
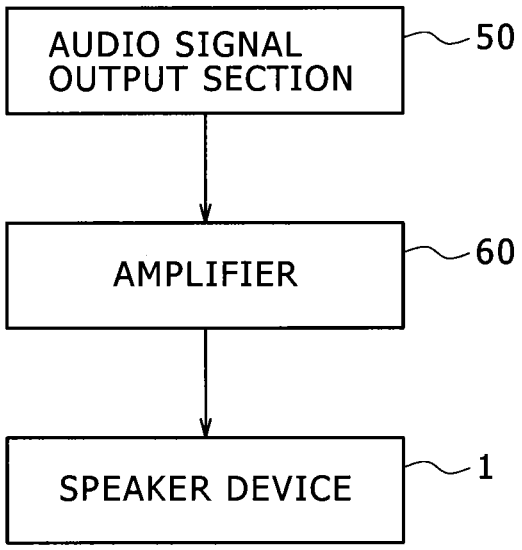
FIG. 1 illustrates, together with FIGS. 2 to 30, a preferred embodiment of a speaker device according to the present technology and is a block diagram illustrating the connection of the speaker device.

A speaker device 1 has, for example, the capability of outputting a sound output from an audio signal output section 50 such as digital music player (DMP) or disc player via an amplifier 60 (refer to FIG. 1).

The sound output from the audio signal output section 50 is amplified by the amplifier 60 and output from the speaker device 1. The same device 1 outputs a sound proportional to the drive voltage or current.

[Specific Configuration of Speaker Device]

Figure 2:
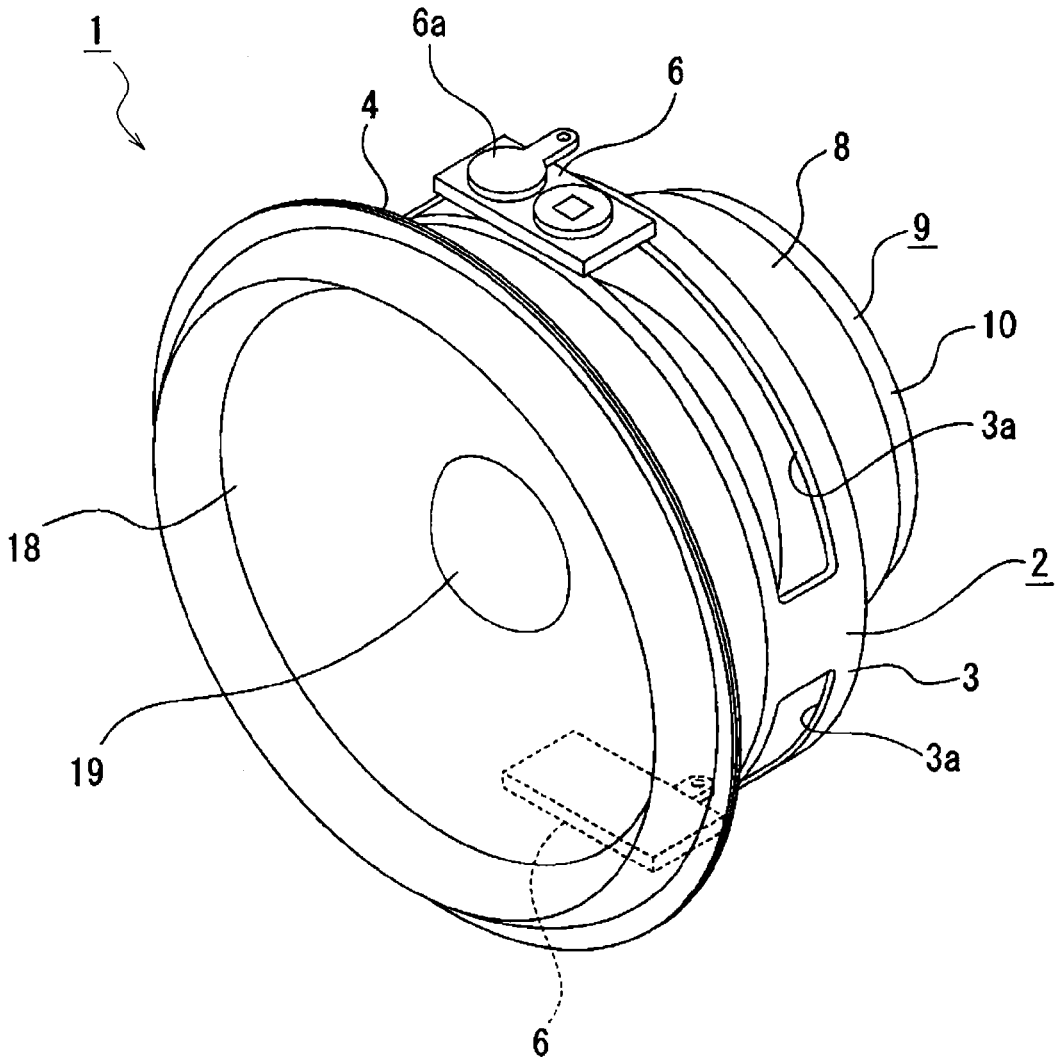
FIG. 2 is an enlarged perspective view of the speaker device.
Figure 3:
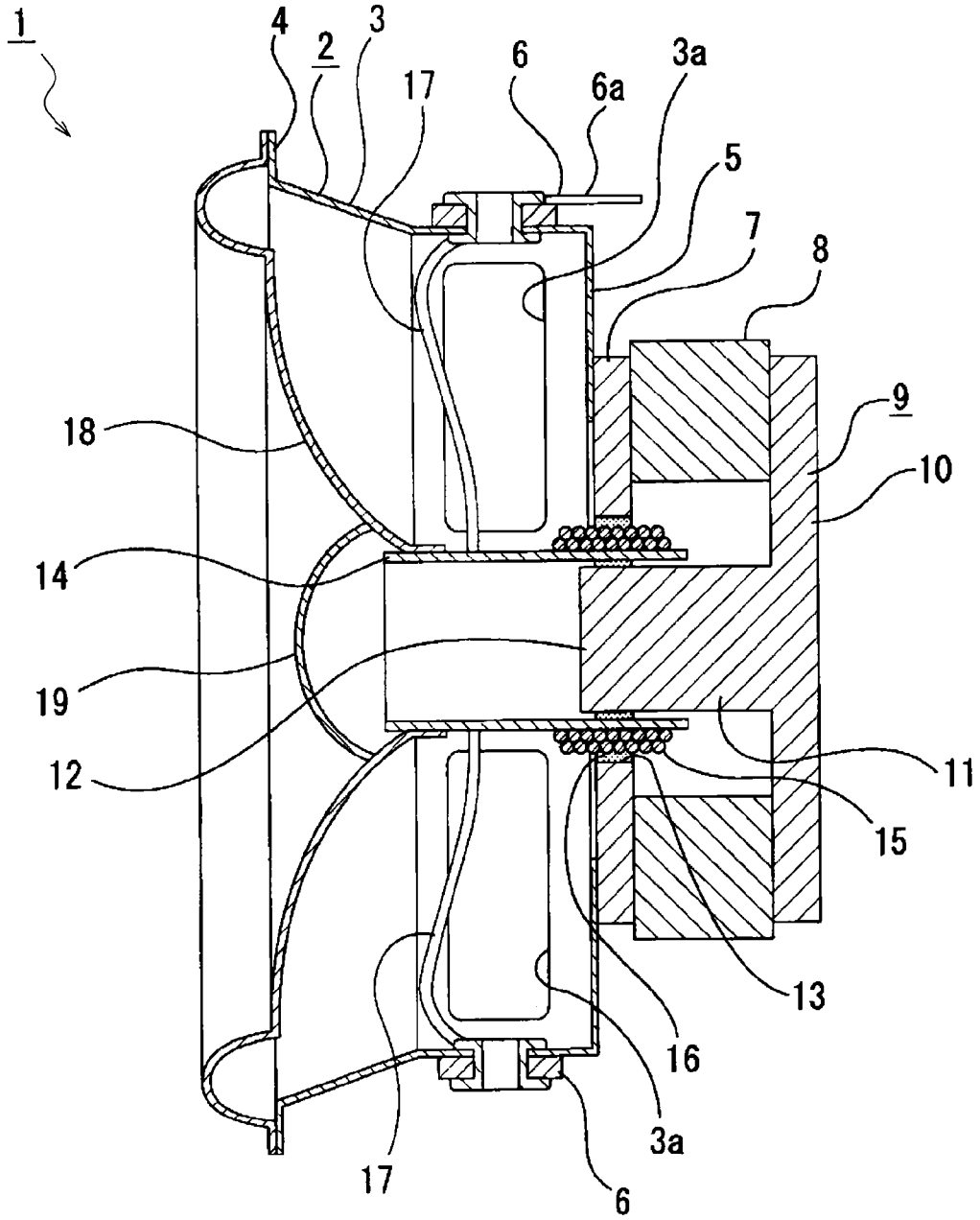
FIG. 3 is an enlarged cross-sectional view of the speaker device.

The speaker device 1 has a frame 2 that serves as an enclosure (refer to FIGS. 2 and 3). The same device 1 is, for example, a woofer adapted to output low-pitched sounds.

The frame 2 has a cylindrical portion 3, attachment section 4 and connecting section 5. The cylindrical portion 3 is formed in an approximately cylindrical shape. The attachment section 4 projects outward from the front edge of the cylindrical portion 3. The connecting section 5 projects inward from the rear edge of the cylindrical portion 3.

A plurality of connecting holes 3*a* are formed in the cylindrical portion 3 to be spaced equidistantly from each other in the circumferential direction. Terminals 6 are attached to the cylindrical portion 3 at the opposite positions 180 degrees apart from each other in the circumferential direction. The terminals 6, provided as connecting sections for connection to the amplifier 60, each have a terminal section 6*a*.

Figure 4:
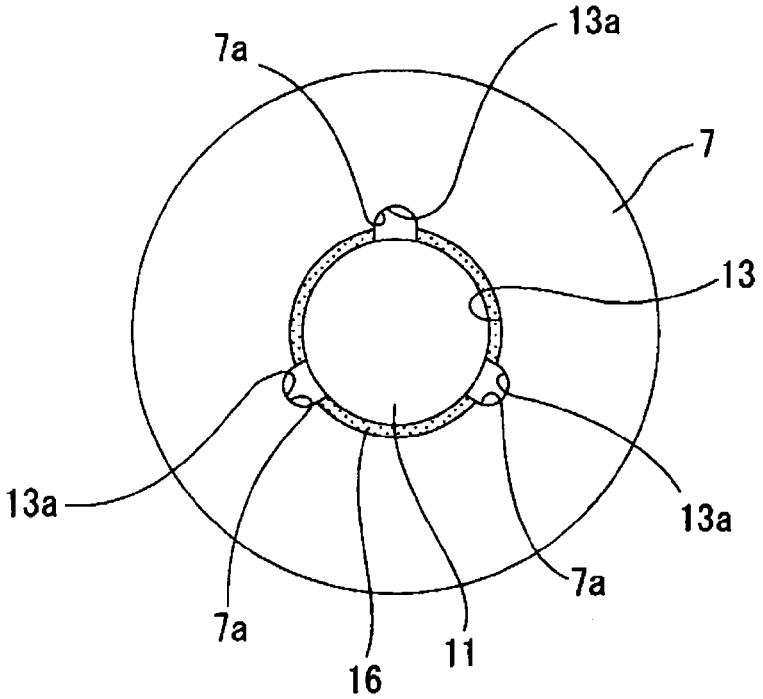
FIG. 4 is an enlarged front view illustrating that a magnetic fluid is filled in a magnetic gap.
Figure 5:
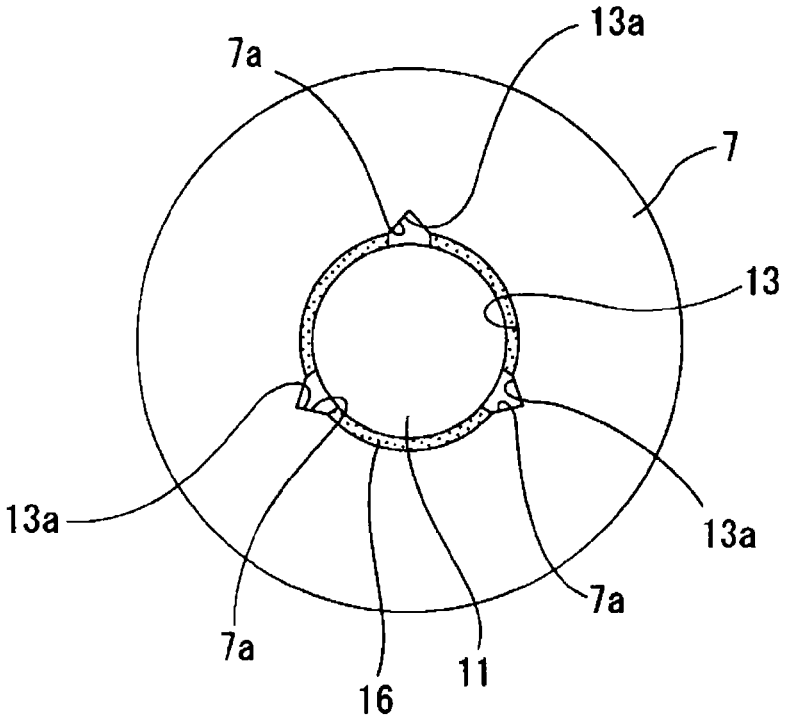
FIG. 5 is an enlarged front view illustrating a plate and center pole portion each having triangular magnetic flux change sections with the magnetic fluid filled in the magnetic gap.
Figure 6:
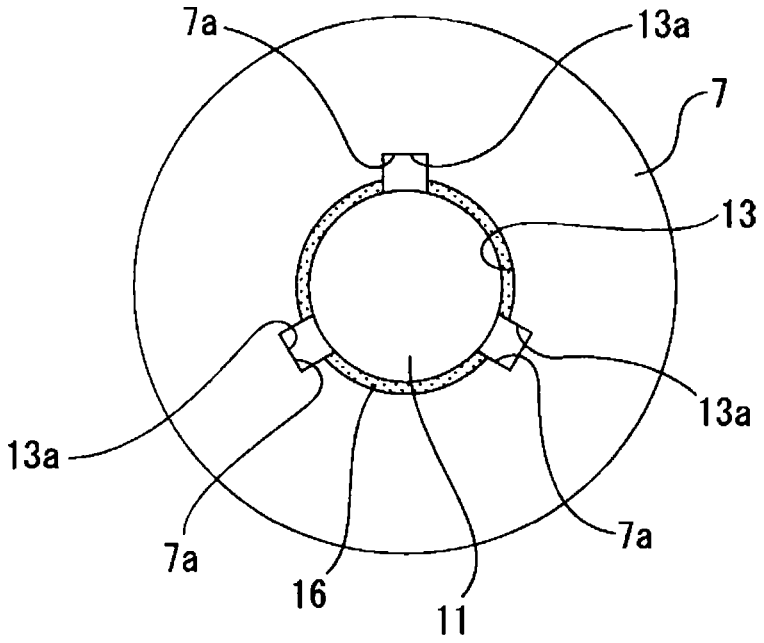
FIG. 6 is an enlarged front view illustrating the plate and center pole portion each having rectangular magnetic flux change sections with the magnetic fluid filled in the magnetic gap.

A plate 7 made of a magnetic material is attached to the rear surface of the connecting section 5 of the frame 2. The plate is formed thin in an approximately annular shape. For example, three concave portions are formed on the inner circumferential surface of the plate 7 to be spaced equidistantly from each other in the circumferential direction. These concave portions are respectively formed as magnetic flux change sections 7*a* (refer to FIG. 4). Each of the magnetic flux change sections 7*a* is formed to extend in the longitudinal direction. The cross-sectional shape of each of the magnetic flux change sections 7*a* perpendicular to the axial direction is, for example, approximately semicircular. However, the magnetic flux change sections 7*a* may have other cross-sectional shape such as triangular (refer to FIG. 5) or rectangular (refer to FIG. 6).

A magnet 8 formed in an annular shape is attached to the rear surface of the plate 7 (refer to FIGS. 2 and 3).

A yoke 9 is attached to the rear surface of the magnet 8. The yoke 9 includes a base surface portion 10 and center pole portion 11 that are formed integrally with each other. The base surface portion 10 is in the shape of a disk. The center pole portion 11 protrudes forward from the center of the base surface portion 10 and has, for example, a cylindrical shape. The yoke 9 has the front surface of the base surface portion 10 attached to the magnet 8.

The plate 7, magnet 8 and yoke 9 are coupled together with their central axes aligned. The yoke 9 is arranged, for example, in such a manner that the front end of the center pole portion 11 protrudes forward from the plate 7. The space between the plate 7 and center pole portion 11 is formed as a magnetic gap 13 (refer to FIGS. 3 and 4). The front end of the center pole portion 11 is provided as a magnetic flux change section 12.

A coil bobbin 14 is supported by the center pole portion 11 of the yoke 9 in such a manner that the coil bobbin 14 is movable in the axial direction of the center pole portion 11. The coil bobbin 14 is formed in a cylindrical shape, and a voice coil 15 is wrapped around the outer circumferential surface on the rear side of the coil bobbin 14. At least part of the voice coil 15 is located in the magnetic gap 13. The plate 7, magnet 8 and yoke 9 form a magnetic circuit as a result of the fact that the voice coil 15 is located in the magnetic gap 13.

A magnetic fluid 16 is filled in the magnetic gap 13. The same fluid 16 is prepared by dispersing magnetic substance fine particles in water or oil using a surfactant. The saturated magnetic flux of the magnetic fluid 16 is 30 mT to 40 mT, and the viscosity thereof is 300 cp (centipoise) (=3 Pa·s (pascal-second)) or less.

Figure 7:
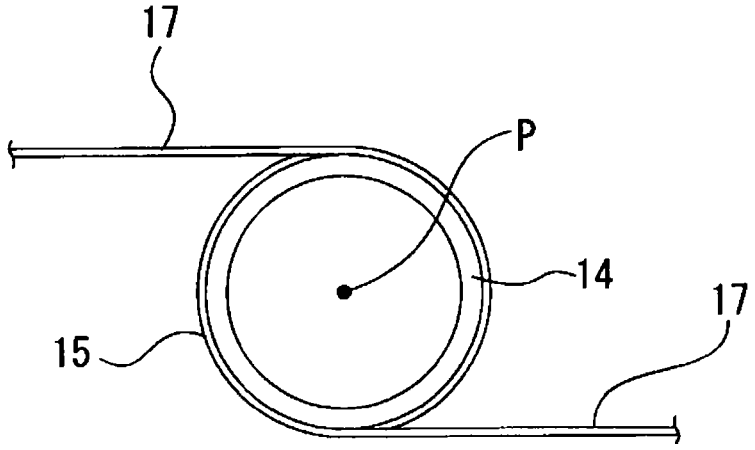
FIG. 7 is a schematic enlarged front view illustrating a coil bobbin and leads.

Each end of the voice coil 15 is connected to the terminal section 6*a* of one of the terminals 6 by a lead 17. The leads 17 are attached to the coil bobbin 14 while being arranged symmetrically with respect to a central axis P of the coil bobbin 14 (refer to FIG. 7). The leads 17 are arranged, for example, linearly.

It should be noted that the number of the leads 17 is arbitrary so long as there are the two or more leads 17. Therefore, there may be the three or more leads 17.

A ring-shaped diaphragm 18 is arranged on the front end side of the frame 2 (refer to FIGS. 2 and 3). The diaphragm 18 has its outer circumferential edge attached to the attachment section 4 of the frame 2 and its inner circumferential edge attached to the front end of the coil bobbin 14. Therefore, the diaphragm 18 is vibrated about its outer circumferential portion as a pivot as the coil bobbin 14 moves in the axial direction.

A center cap 19 is attached to the inner circumferential portion of the diaphragm 18, and the coil bobbin 14 is closed from the front by the center cap 19.

In the speaker device 1, the magnetic flux change sections 7*a* are formed on the plate 7 as described above (refer to FIG. 4). The magnetic flux change sections 7*a* of the plate 7 have the capability of forming magnetic gradients Sa adapted to change the magnetic force acting on the magnetic fluid 16 by changing the magnetic flux density of the magnetic gap in the circumferential direction (refer to FIG. 8). Therefore, the magnetic fluid 16 filled in the magnetic gap 13 is held in the areas with a high magnetic flux density. A cavity 13*a* is formed between the outer circumferential surface of the center pole portion 11 and the inner circumferential surface of the plate 7 in each of the areas where the magnetic flux change section 7*a* is formed (refer to FIG. 4).

Figure 8:
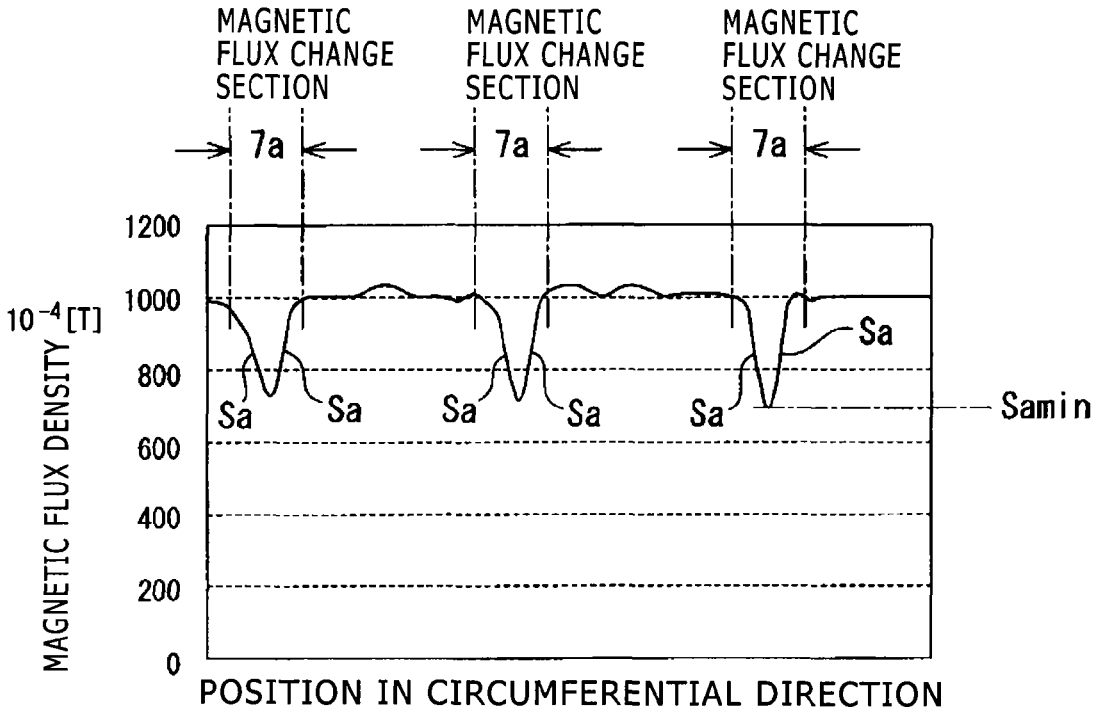
FIG. 8 is a graph illustrating the magnetic flux density in the circumferential direction of the magnetic gap.
Figure 8:
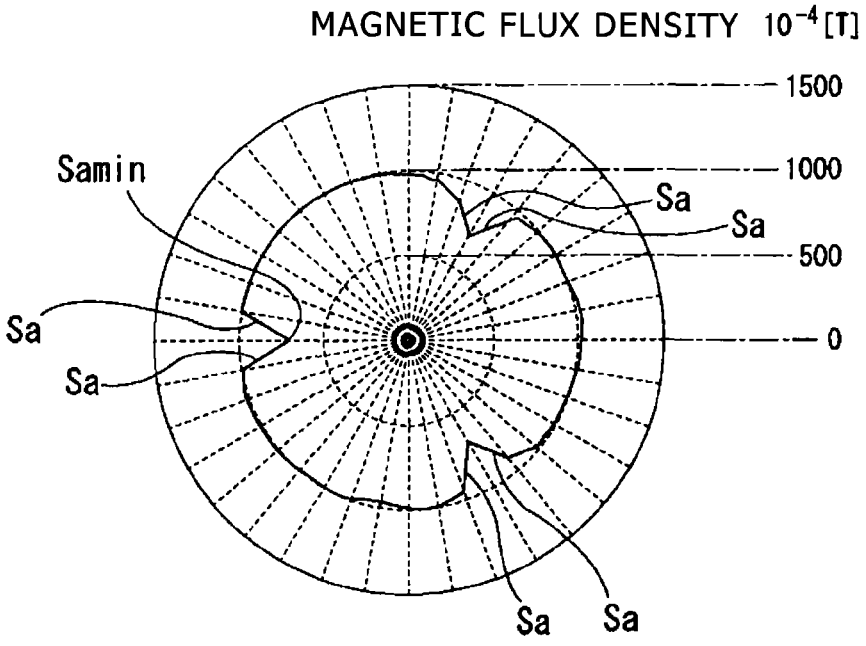

FIG. 8 is a graph illustrating the magnetic flux density in the circumferential direction of the magnetic gap 13. As illustrated in FIG. 8, the magnetic gradient (sloping portion) Sa is formed by each of the magnetic flux change sections 7*a* in each of the areas where one of the magnetic flux change sections 7*a* of the plate 7 is formed. In these areas, the magnetic force is smaller than in other areas. The magnetic gradient Sa changes the magnetic flux density in such a manner that although there is a magnetic force, the closer to the center of the magnetic flux change section 7*a*, the smaller the magnetic force.

Further, in the speaker device 1, the magnetic flux change section 12 is formed in the center pole portion 11 of the yoke 9 as described above (refer to FIG. 3). The magnetic flux change section 12 of the center pole portion 11 has the capability of forming a magnetic gradient Sb adapted to change the magnetic force acting on the magnetic fluid 16 by changing the magnetic flux density in the axial direction, that is, in the direction in which the coil bobbin 14 moves (refer to FIG. 9).

Figure 9:
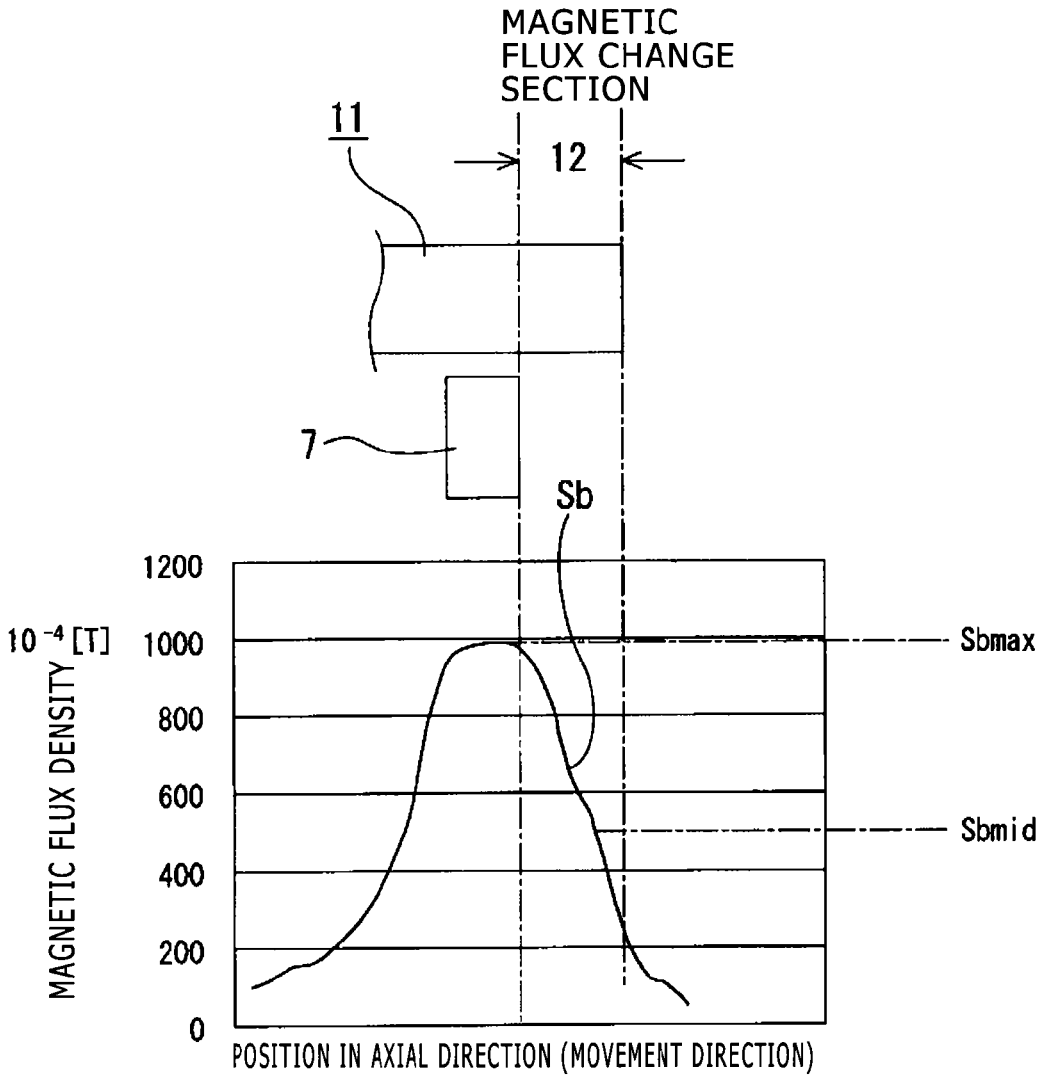
FIG. 9 is a graph illustrating the magnetic flux density in the axial direction of the magnetic gap.

FIG. 9 is a graph illustrating the magnetic flux density in the axial direction. As illustrated in FIG. 9, the magnetic gradient (sloping portion) Sb is formed by the magnetic flux change section 12 in the area where the magnetic flux change section 12 of the center pole portion 11 is formed. In this area, the magnetic force is smaller than in the area opposed to the plate 7. The magnetic gradient Sb changes the magnetic flux density in such a manner that although there is a magnetic force, the farther away from the plate 7, the smaller the magnetic force.

It should be noted that, in the speaker device 1, a minimum magnetic flux density Samin in the circumferential direction (refer to FIG. 8) is greater than a value Sbmid which is half a highest magnetic flux density Sbmax in the axial direction (refer to FIG. 9).

[Operation of Speaker Device]

In the speaker device 1 configured as described above, when a drive voltage or current is supplied to the voice coil 15, the magnetic circuit produces a thrust, allowing the coil bobbin 14 to move in the longitudinal direction (axial direction). As the coil bobbin 14 moves, the diaphragm 18 vibrates. At this time, a sound proportional to the voltage or current is output. That is, a sound output from the audio signal output section 50 and amplified by the amplifier 60 is output.

During sound output, a force is applied to the magnetic fluid 16 filled in the magnetic gap 13 to cause it to fly off as the coil bobbin 14 moves. In the speaker device 1, however, the magnetic gradients Sa adapted to change the magnetic force acting on the magnetic fluid 16 are formed by the magnetic flux change sections 7*a* in the circumferential direction. Further, the minimum magnetic flux density Samin in the circumferential direction is greater than the value Sbmid which is half the highest magnetic flux density Sbmax in the axial direction.

Figure 10:
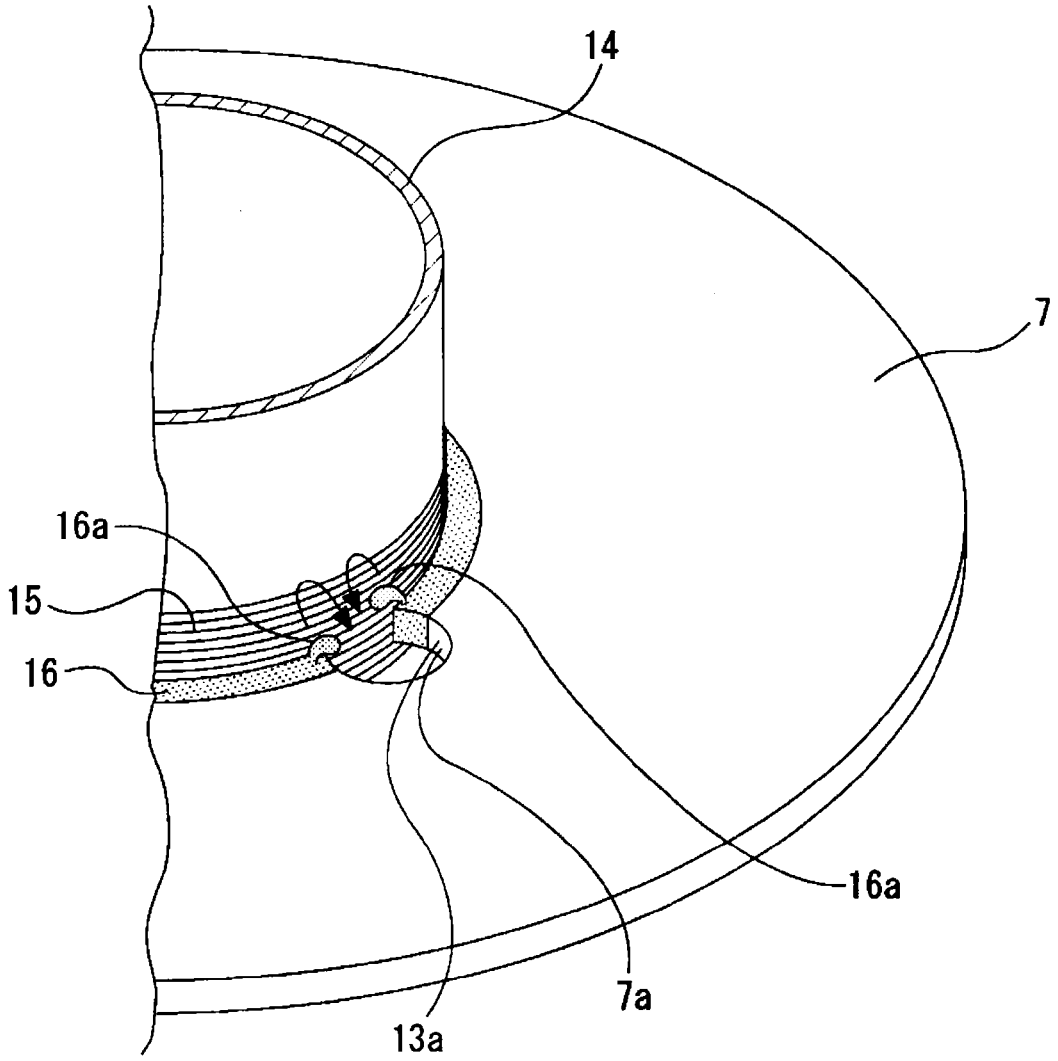
FIG. 10 is a schematic enlarged perspective view illustrating that part of the magnetic fluid is attracted to the side of the magnetic flux change section adapted to form a magnetic gradient by changing the magnetic flux density in the circumferential direction during the movement of the coil bobbin.

Therefore, part 16*a* of the magnetic flux 16 attempting to fly off in the axial or circumferential direction is attracted from the cavity 13*a*, i.e., an area with a magnetic force where the magnetic gradient Sa is formed, to the magnetic gap 13 as illustrated in FIG. 10, thus inhibiting the magnetic fluid from flying off.

Figure 11:
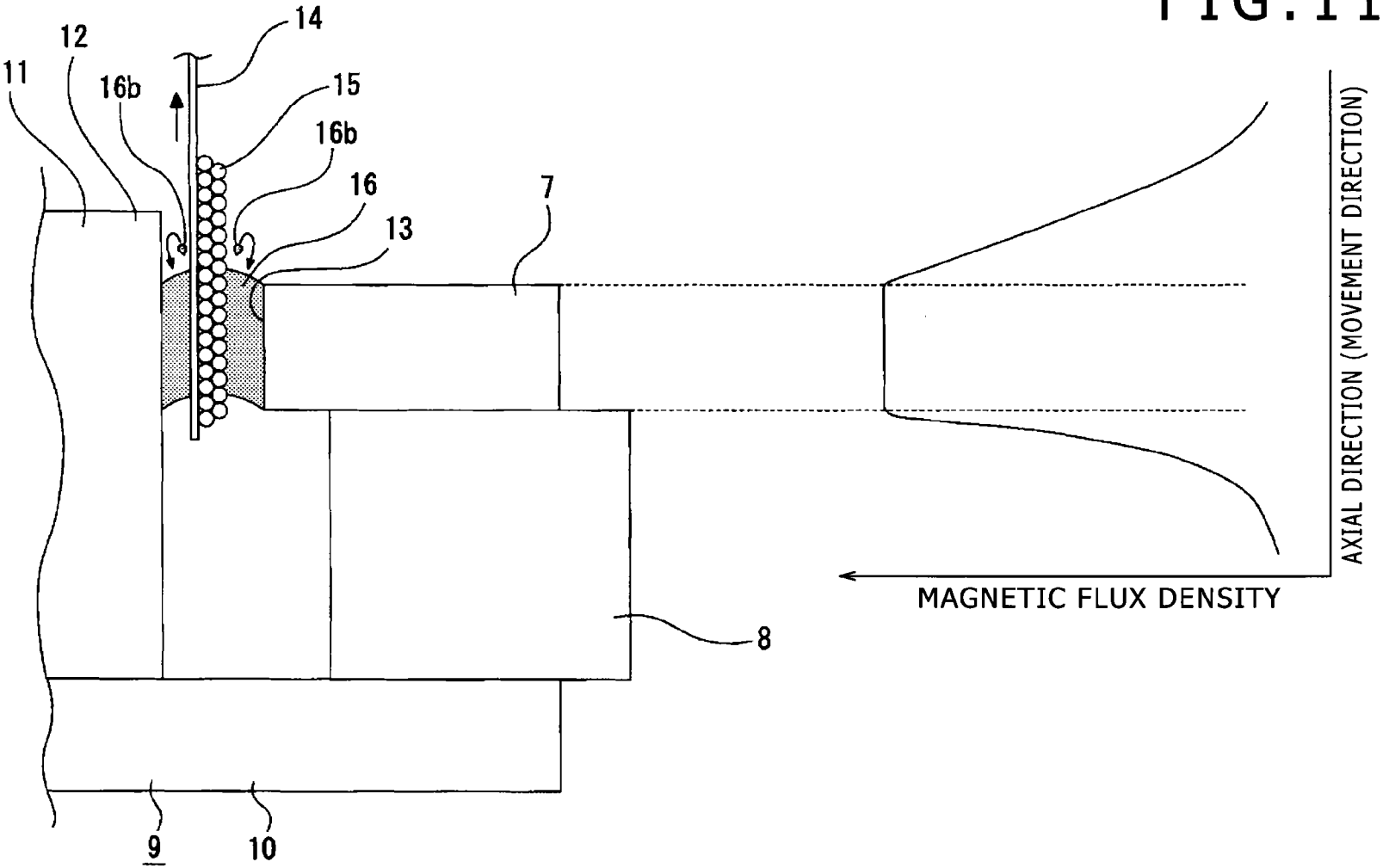
FIG. 11 is a schematic enlarged perspective view illustrating that part of the magnetic fluid is attracted to the side of the magnetic flux change section adapted to form a magnetic gradient by changing the magnetic flux density in the axial direction during the movement of the coil bobbin.

Further, part 16*b* of the magnetic flux 16 attempting to fly off in the axial direction is attracted from an area with a magnetic force where the magnetic gradient Sb is formed, to the magnetic gap 13 as illustrated in FIG. 11, thus inhibiting the magnetic fluid from flying off.

Still further, in the speaker device 1, the leads 17 are attached to the coil bobbin 14 symmetrically with respect to the central axis P of the coil bobbin 14 as described above (refer to FIG. 7). Therefore, tensions that are approximately 180 degrees apart, that is, that act in the approximately opposite directions are applied to the coil bobbin 14 by the leads 17, making the rolling phenomenon, i.e., a phenomenon causing the coil bobbin 14 to tilt in the direction in which the axis falls, unlikely.

[Measurement Data Relating to Speaker Device]

A description will be given below of measurement data relating to the speaker device 1 (refer to FIGS. 12 to 14).

A description will be given first of measurement data of the sound pressure level (refer to FIG. 12). FIG. 12 is a graph illustrating measurement data about the relationship between the frequency and sound pressure level of a speaker device according to related art with a damper and the speaker device 1 with no damper and with the magnetic fluid 16 filled therein.

Figure 12:
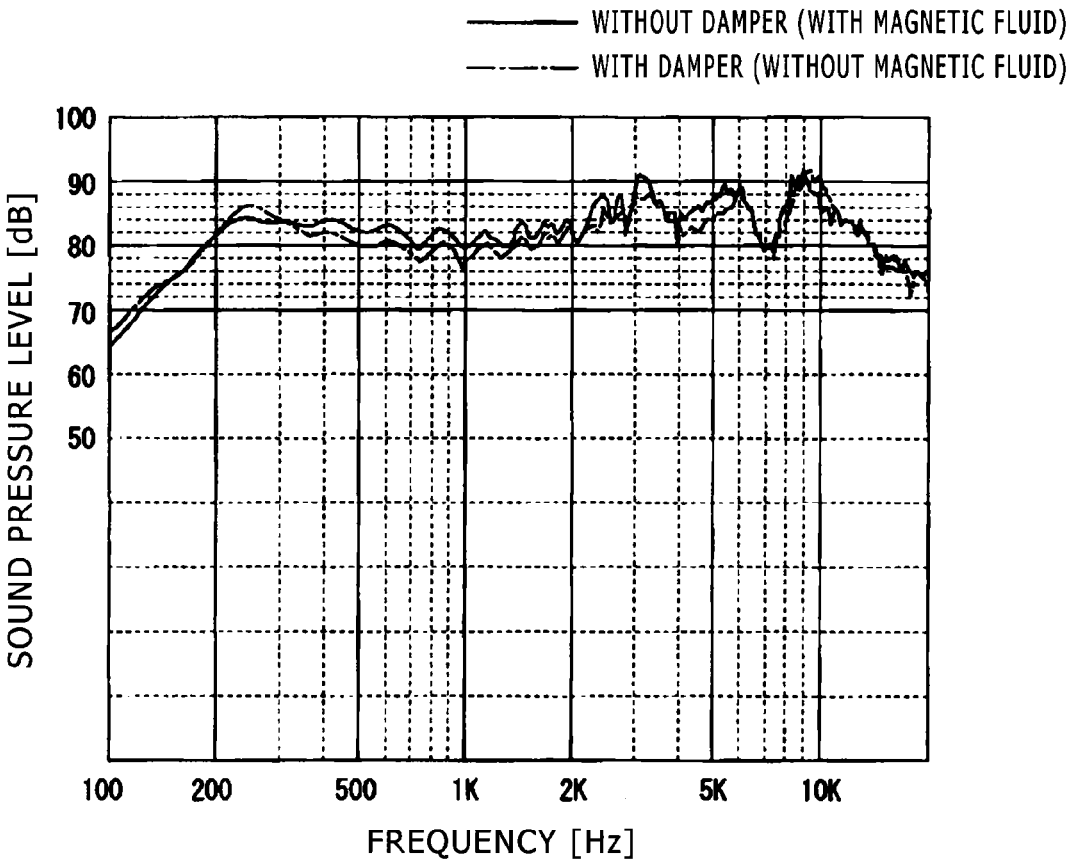
FIG. 12 is a graph illustrating measurement data about the relationship between the frequency and sound pressure level of a speaker device according to related art with a damper and a speaker device with no damper and with the magnetic fluid filled therein.

As illustrated in FIG. 12, the speaker device 1 with no damper and with the magnetic fluid 16 filled therein offers enhanced acoustic conversion efficiency, thus providing about 2.1 dB improvement in sound pressure level. Among factors responsible for the improved sound pressure level are firstly reduced inhibition of the movement of the coil bobbin 14 by the damper, secondly improved acoustic conversion efficiency made possible by the reduction in weight of the speaker device 1 thanks to the absence of a damper, thirdly improved acoustic conversion efficiency made possible by the reduction in weight of the speaker device 1 as a result of downsizing of the coil bobbin 14 because the portion for attaching a damper is not necessary thanks to the absence of a damper.

A description will be given next of measurement data relating to the occurrence of an abnormal noise in the presence and absence of magnetic flux change sections (refer to FIG. 13). The diagram at the top in FIG. 13 is a graph illustrating measurement data showing the relationship between time and frequency for a speaker device according to related art. Although having the magnetic fluid 16 filled therein, the speaker device has no magnetic flux change sections adapted to change the magnetic flux density in the circumferential direction. The diagram at the bottom in FIG. 13 is a graph illustrating measurement data showing the relationship between time and frequency for the speaker device 1. The same device 1 has a magnetic fluid filled in the magnetic gap and has the magnetic flux change sections 7*a* adapted to change the magnetic flux density in the circumferential direction formed therein.

Figure 13:
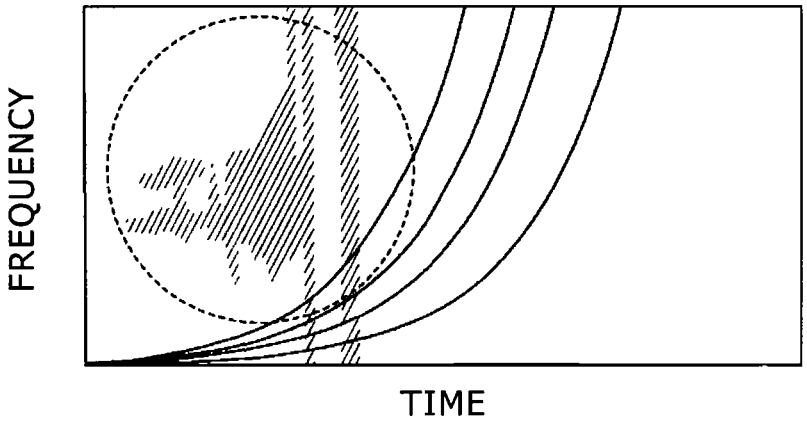
FIG.13 (RELATED ART)
FIG. 13 is graphs illustrating measurement data about the relationship between the time and frequency to describe the action of the magnetic flux change section adapted to change the magnetic flux density in the circumferential direction.
Figure 13:
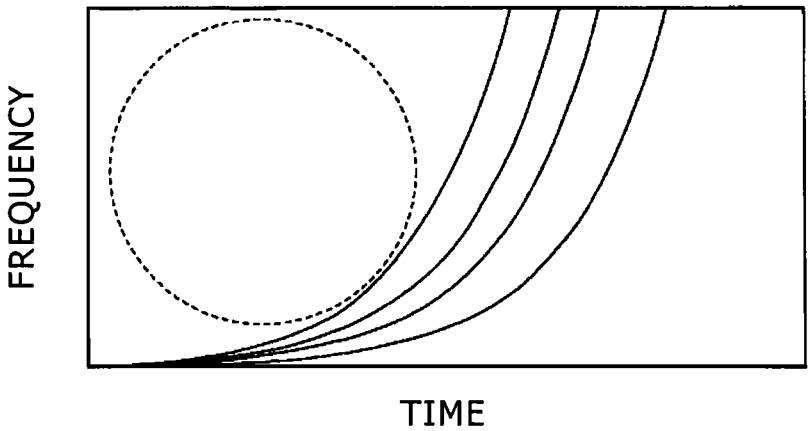
FIG.13 (RELATED ART)

As illustrated in FIG. 13, the magnetic fluid is agitated by the voice coil during the movement of the coil bobbin in the speaker device according to related art, thus producing an abnormal noise (see inside the circle drawn with a dashed line in the diagram at the top) that distorts the output sound (reproduced sound).

In the speaker device 1 having the magnetic flux change sections 7*a* formed therein, on the other hand, the magnetic fluid 16 is held in the areas other than the cavities 13*a*, thus restricting the area in which the magnetic fluid 16 flows during the movement of the coil bobbin. This makes the agitation of the magnetic flux unlikely, thus making it unlikely that an abnormal noise that distorts the output sound may be produced (see inside the circle drawn with a dashed line in the diagram at the bottom). Therefore, it is possible to inhibit the agitation of the magnetic fluid 16 by forming the magnetic flux change sections 7*a* on the plate 7, thus contributing to improved quality of the output sound.

A description will be given next of measurement data relating to the occurrence of an abnormal noise depending on the arrangement of leads (refer to FIG. 14). The diagram at the top in FIG. 14 is a graph illustrating measurement data showing the relationship between time and frequency for a speaker device according to related art. The speaker device has two leads connected to the coil bobbin in the same direction. The diagram at the bottom in FIG. 14 is a graph illustrating measurement data showing the relationship between time and frequency for the speaker device 1. The same device 1 has the three leads 17 connected to the coil bobbin 14 and arranged in such a manner to be 120 degrees apart from one another in the circumferential direction.

Figure 14:
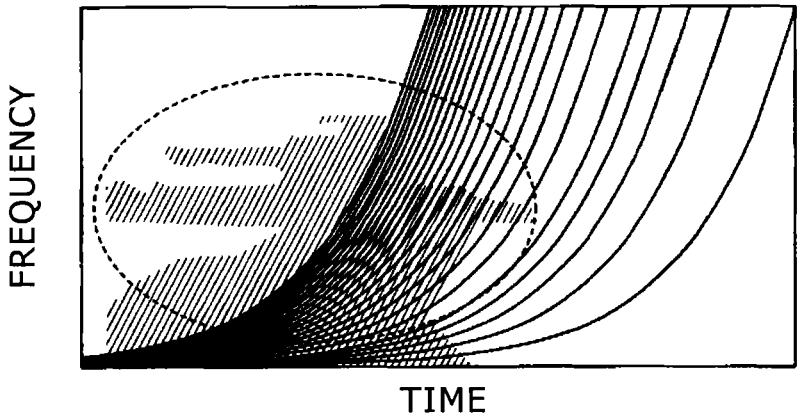
FIG.14 (RELATED ART)
FIG. 14 is graphs illustrating measurement data about the relationship between the time and frequency to describe the action of the arrangement of the leads.
Figure 14:
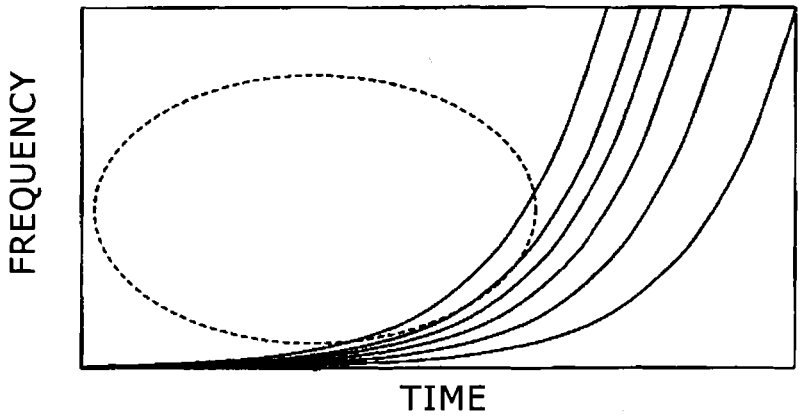
FIG.14 (RELATED ART)
Figure 15:
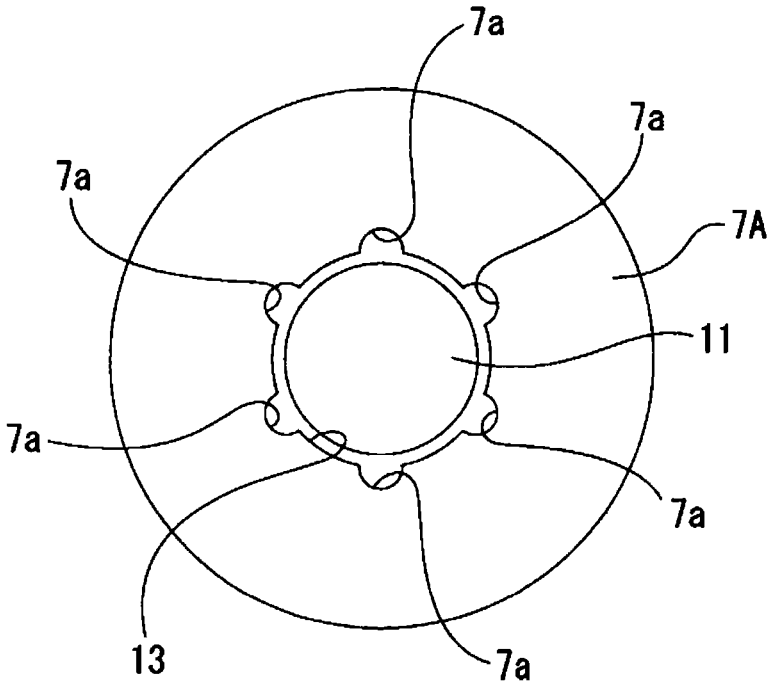
FIG. 15 illustrates, together with FIGS. 16 to 18, modification examples of the magnetic flux change section adapted to form a magnetic gradient in the circumferential direction, and is an enlarged front view illustrating a first modification example.
Figure 16:
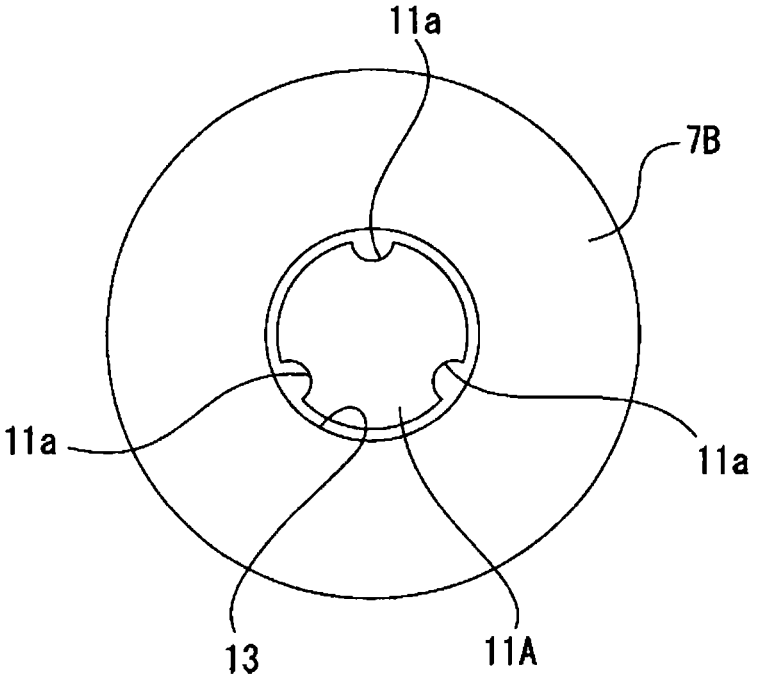
FIG. 16 is an enlarged front view illustrating a second modification example.
Figure 17:
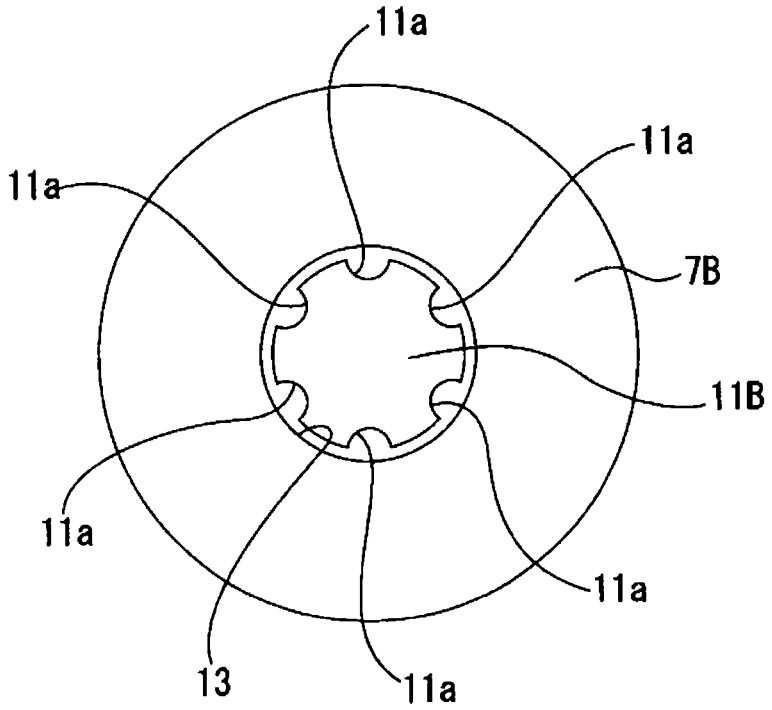
FIG. 17 is an enlarged front view illustrating a third modification example.
Figure 18:
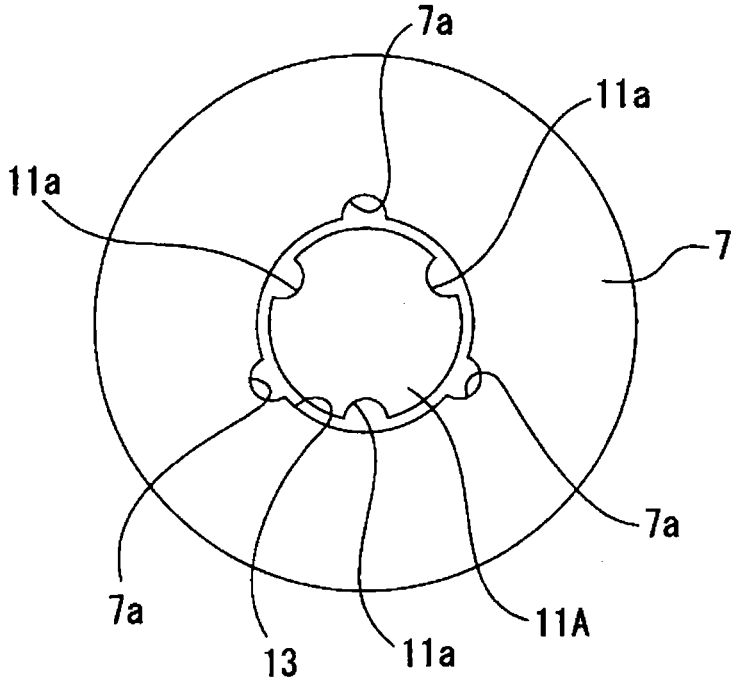
FIG. 18 is an enlarged front view illustrating a fourth modification example.
Figure 19:
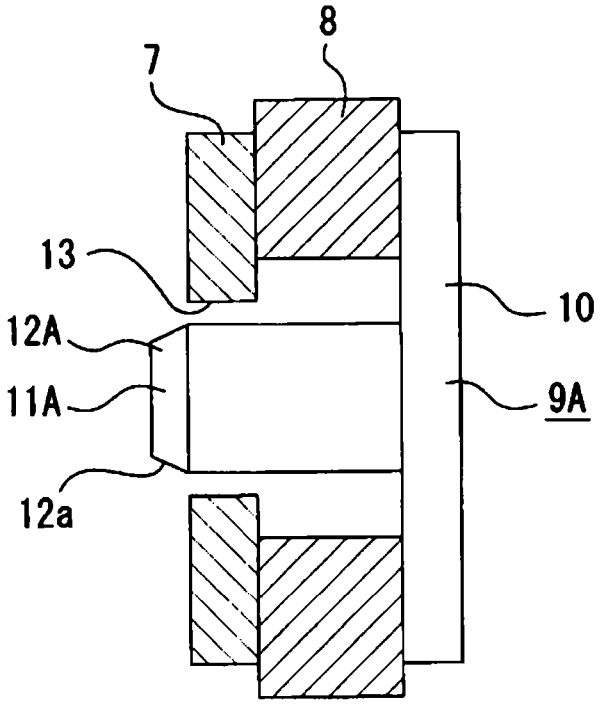
FIG. 19 illustrates, together with FIGS. 20 to 25, modification examples of the magnetic flux change section adapted to form a magnetic gradient in the axial direction, and is an enlarged cross-sectional view illustrating a first modification example.
Figure 20:
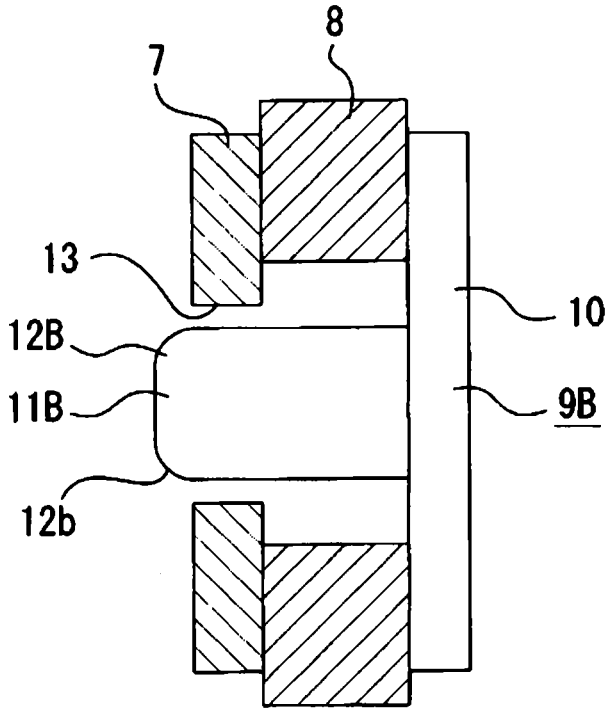
FIG. 20 is an enlarged cross-sectional view illustrating a second modification example.

As illustrated in FIG. 14, tensions are applied to the coil bobbin in the same direction during the movement of the coil bobbin in the speaker device according to related art in which the two leads are connected to the coil bobbin in the same direction, thus resulting in the rolling phenomenon and producing an abnormal noise that distorts the output sound (see inside the ellipse drawn with a dashed line in the diagram at the top).

In the speaker device 1 having the three leads 17 connected in a symmetric manner, on the other hand, tensions of the same magnitude are applied to the coil bobbin 14 by the leads 17 in the same direction during the movement of the coil bobbin 14, thus eliminating the rolling phenomenon and making it unlikely that an abnormal noise that distorts the output sound may be produced (see inside the ellipse drawn with a dashed line in the diagram at the bottom). Therefore, it is possible to inhibit the rolling phenomenon by arranging the leads 17 symmetrically with respect to the central axis P of the coil bobbin 14, thus contributing to improved quality of the output sound.

Modification Examples 1

A description will be given below of modification examples of the magnetic flux change sections adapted to form magnetic gradients in the circumferential direction of the center pole portion of the yoke (refer to FIGS. 15 to 18).

It should be noted that the magnetic flux change sections according to the modification examples shown below are formed on the plate or the center pole portion of the yoke. In the description given below, only the differences from the plate 7 and center pole portion 11 will be described below. The plate or center pole portion similar to that of the speaker device 1 described above will be denoted by the same reference numeral, and the description thereof will be omitted.

First Modification Example

For example, six concave portions are formed to be spaced equidistantly from each other in the circumferential direction on the inner circumferential surface of the plate 7. Each of these concave portions is formed as the magnetic flux change section 7*a* according to the first modification example (refer to FIG. 15). Each of the magnetic flux change sections 7*a* is formed to extend in the longitudinal direction.

It should be noted that the number of the magnetic flux change sections 7*a* is arbitrary. Therefore, there may be the two or less magnetic flux change sections 7*a*. Alternatively, there may be the four or more magnetic flux change sections 7*a*.

Further, the cross-sectional shape of each of the magnetic flux change sections 7*a* perpendicular to the axial direction is, for example, approximately semicircular. However, the magnetic flux change sections 7*a* may have other cross-sectional shape such as triangular or rectangular.

Second Modification Example

For example, three concave portions are formed to be spaced equidistantly from each other in the circumferential direction on the outer circumferential surface of the center pole portion 11A. Each of these concave portions is formed as a magnetic flux change section 11*a* according to the second modification example (refer to FIG. 16). Each of the magnetic flux change sections 11*a* is formed to extend in the longitudinal direction. No magnetic flux change sections are formed on a plate 7B.

The cross-sectional shape of each of the magnetic flux change sections 11*a* perpendicular to the axial direction is, for example, approximately semicircular. However, the magnetic flux change sections 11*a* may have other cross-sectional shape such as triangular or rectangular.

Third Modification Example

For example, six concave portions are formed to be spaced equidistantly from each other in the circumferential direction on the outer circumferential surface of a center pole portion 11B. Each of these concave portions is formed as the magnetic flux change section 11*a* according to the third modification example (refer to FIG. 17). Each of the magnetic flux change sections 11*a* is formed to extend in the longitudinal direction. No magnetic flux change sections are formed on the plate 7B.

It should be noted that the number of the magnetic flux change sections 11*a* is arbitrary. Therefore, there may be the two or less magnetic flux change sections 11*a*. Alternatively, there may be the four or more magnetic flux change sections 11*a*.

Further, the cross-sectional shape of each of the magnetic flux change sections 11*a* perpendicular to the axial direction is, for example, approximately semicircular. However, the magnetic flux change sections 11*a* may have other cross-sectional shape such as triangular or rectangular.

Fourth Modification Example

In the fourth modification example, the plate 7 and a center pole portion 11A are used in combination to form magnetic flux change sections. The magnetic flux change sections 7*a* are provided that are formed to be spaced equidistantly from each other in the circumferential direction. Also, the magnetic flux change sections 11*a* are provided that are formed to be spaced equidistantly from each other in the circumferential direction (refer to FIG. 18). The magnetic flux change sections 7*a* and 11*a* alternate in the circumferential direction.

It should be noted that the number of the magnetic flux change sections 7*a* or 11*a* is arbitrary. Therefore, there may be the two or less magnetic flux change sections 7*a* or 11*a*. Alternatively, there may be the four or more magnetic flux change sections 7*a* or 11*a*.

Further, the cross-sectional shape of each of the magnetic flux change sections 7*a* and 11*a* perpendicular to the axial direction is, for example, approximately semicircular. However, the magnetic flux change sections 7*a* and 11*a* may have other cross-sectional shape such as triangular or rectangular.

As described above, the magnetic flux change sections 7*a* and 11*a* are formed respectively on the plate 7 and center pole portion 11A. This ensures a higher degree of freedom in changing the magnetic flux density, thus contributing to improved degree of freedom in design.

Further, the magnetic flux change sections 7*a* formed on the plate 7 and the magnetic flux change sections 11*a* formed on the center pole portion 11A alternate in the circumferential direction. This provides an excellent magnetic balance thanks to the symmetrical arrangement of the magnetic flux change sections 7*a* and 11*a*, thus allowing for smooth movement of the coil bobbin 14.

[Conclusion of Magnetic Flux Change Sections Adapted to Form Magnetic Gradients in Circumferential Direction]

As described above, the plurality of magnetic flux change sections 7*a* or 11*a* are provided to be spaced equidistantly from each other in the circumferential direction. This provides an excellent magnetic balance thanks to the symmetrical arrangement of the magnetic flux change sections 7*a* or 11*a*, thus allowing for smooth movement of the coil bobbin 14.

Further, concave portions extending in the axial direction are formed as the magnetic flux change sections 7*a* and 11*a*. This makes it easy to form the magnetic flux change sections 7*a* and 11*a* and keeps the outer diameter of the speaker device 1 unchanged, thus contributing to downsizing of the speaker device 1.

Modification Examples 2

A description will be given next of modification examples of the magnetic flux change section adapted to form a magnetic gradient in the axial direction of the center pole portion of the yoke (refer to FIGS. 19 to 25).

It should be noted that the magnetic flux change sections according to the modification examples shown below are formed on the plate or the center pole portion of the yoke. In the description given below, only the differences from the plate 7 and center pole portion 11 will be described below. The plate or center pole portion similar to that of the speaker device 1 described above will be denoted by the same reference numeral, and the description thereof will be omitted.

First Modification Example

A yoke 9A is arranged in such a manner that the front end of the center pole portion 11A protrudes forward from the plate 7. The front end of the center pole portion 11A is provided as a magnetic flux change section 12A according to the first modification example (refer to FIG. 19). The magnetic flux change section 12A is formed in such a manner that the diameter thereof diminishes toward the front. The outer circumferential surface thereof is a sloping surface 12*a*.

Second Modification Example

A yoke 9B is arranged in such a manner that the front end of the center pole portion 11B protrudes forward from the plate 7. The front end of the center pole portion 11B is provided as a magnetic flux change section 12B according to the second modification example (refer to FIG. 20). The magnetic flux change section 12B is formed in such a manner that the diameter thereof diminishes toward the front. The outer circumferential surface thereof is a curved surface 12*b*.

Third Modification Example

Figure 21:
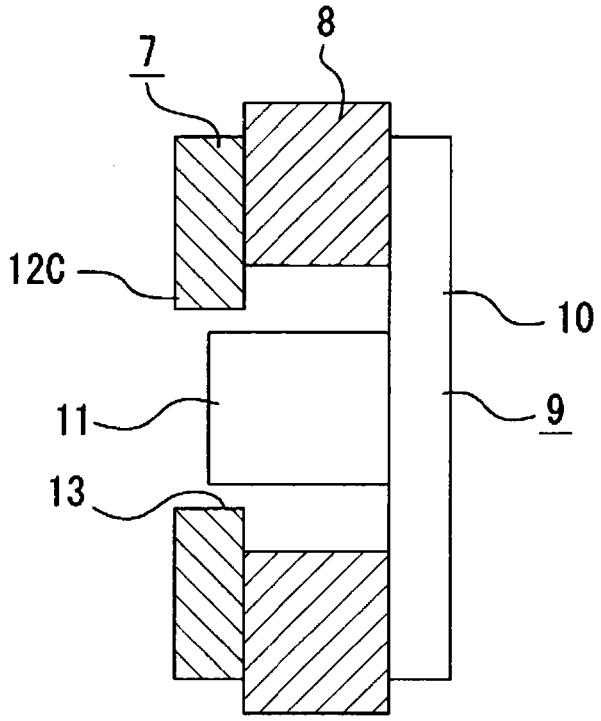
FIG. 21 is an enlarged cross-sectional view illustrating a third modification example.

The yoke 9 is arranged in such a manner that the front surface of the center pole portion 11 is located between the front and rear surfaces of the plate 7 (refer to FIG. 21). Therefore, the front end of the plate 7 is located forward of the front surface of the center pole portion 11. The front end of the plate 7 is provided as a magnetic flux change section 12C according to the third modification example.

Fourth Modification Example

Figure 22:
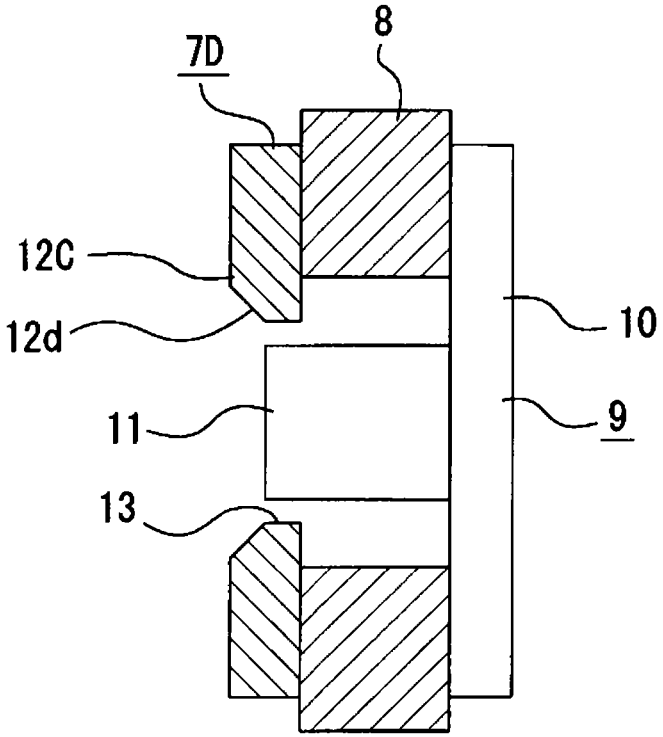
FIG. 22 is an enlarged cross-sectional view illustrating a fourth modification example.

The yoke 9 is arranged in such a manner that the front edge of the center pole portion 11 is located between the front and rear surfaces of a plate 7D (refer to FIG. 22). Therefore, the front end of the plate 7D is located forward of the front surface of the center pole portion 11. The front end of the plate 7D is provided as a magnetic flux change section 12D according to the fourth modification example. The magnetic flux change section 12D is formed in such a manner that the diameter thereof diminishes toward the front. The inner circumferential surface thereof is a sloping surface 12*d*.

Fifth Modification Example

Figure 23:
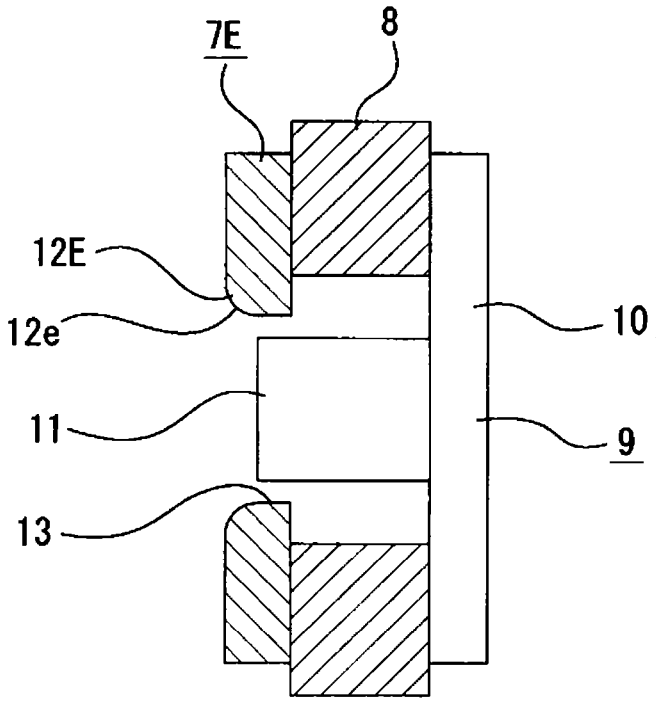
FIG. 23 is an enlarged cross-sectional view illustrating a fifth modification example.
Figure 24:
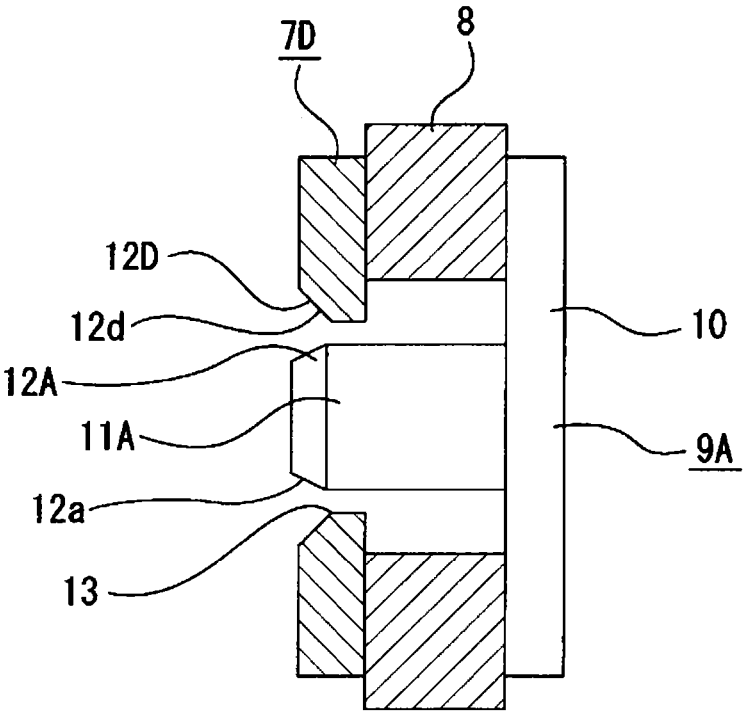
FIG. 24 is an enlarged cross-sectional view illustrating a sixth modification example.
Figure 25:
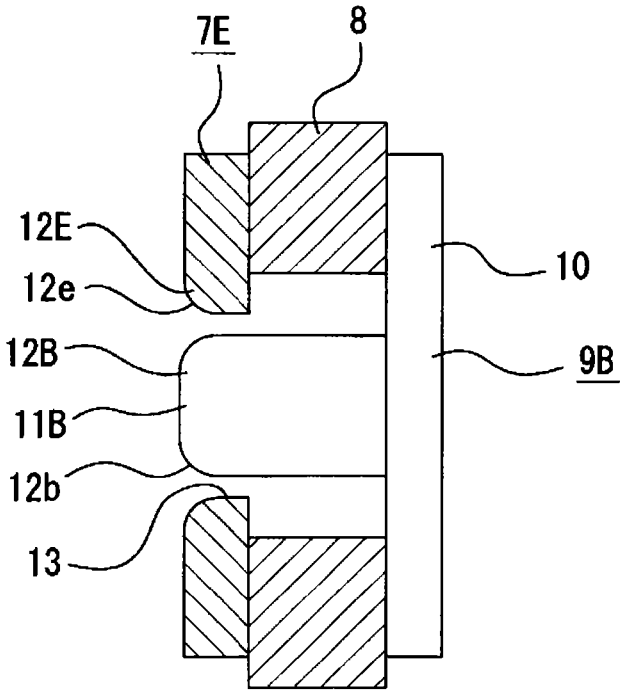
FIG. 25 is an enlarged cross-sectional view illustrating a seventh modification example.

The yoke 9 is arranged in such a manner that the front edge of the center pole portion 11 is located between the front and rear surfaces of a plate 7E (refer to FIG. 23). Therefore, the front end of the plate 7E is located forward of the front surface of the center pole portion 11. The front end of the plate 7E is provided as a magnetic flux change section 12E according to the fifth modification example. The magnetic flux change section 12E is formed in such a manner that the diameter thereof diminishes toward the front. The inner circumferential surface thereof is a sloping surface 12*e*.

Sixth Modification Example

In the sixth modification example, the yoke 9A and plate 7D are used in combination to form magnetic flux change sections. The front surface of the center pole portion 11A is located on the same plane as that of the plate 7D. The magnetic flux change sections 12A and 12D are provided (refer to FIG. 24).

Seventh Modification Example

In the seventh modification example, the yoke 9B and plate 7E are used in combination to form magnetic flux change sections. The front surface of the center pole portion 11B is located on the same plane as that of the plate 7E. The magnetic flux change sections 12B and 12E are provided (refer to FIG. 25).

If the magnetic flux change sections 12A and 12B are provided respectively on the center pole portions 11A and 11B, and if the magnetic flux change sections 12D and 12E are provided respectively on the plates 7D and 7E as in the sixth and seventh modification examples, this ensures a higher degree of freedom in changing the magnetic flux density, thus contributing to improved degree of freedom in design.

[Conclusion of Magnetic Flux Change Sections Adapted to Form Magnetic Gradients in Axial Direction]

If the sloping surface 12*a* or 12*d* is formed, and if the portion with the sloping surface 12*a* or 12*d* is used as the magnetic flux change section 12A or 12D as in the first, fourth or sixth modification example described above, this makes it easy to work on the magnetic flux change section 12A or 12D and form a magnetic gradient.

Further, if the curved surface 12*b* or 12*e* is formed, and if the portion with the curved surface 12*b* or 12*e* is used as the magnetic flux change section 12B or 12E as in the second, fifth or seventh modification example described above, this makes it easy to form a desired magnetic gradient.

Modification Examples 3

A description will be given next of modification examples of the arrangement of leads or other wires with respect to the coil bobbin (refer to FIGS. 26 to 30).

It should be noted that only the leads or other wires will be described in the modification examples given below. The coil bobbin around which the voice coil, to which the leads or other wires are to be connected, is wrapped will be denoted by the same reference numeral, and the description thereof will be omitted.

First Modification Example

Figure 26:
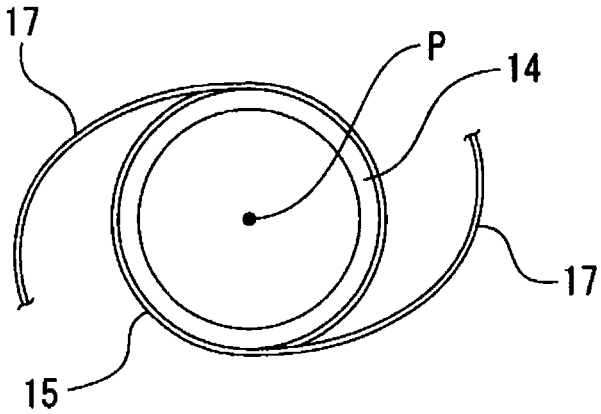
FIG. 26 illustrates, together with FIGS. 27 to 30, modification examples of the arrangement of the leads or other wires with respect to the coil bobbin, and is an enlarged front view illustrating a first modification example.

In the first modification example, the two leads 17 are attached to the coil bobbin 14 while being arranged symmetrically with respect to the central axis P of the coil bobbin 14, and the leads 17 are arranged in a curved manner (refer to FIG. 26). It should be noted that the three or more leads 17 may be provided so long as they are arranged symmetrically with respect to the central axis P of the coil bobbin 14.

Second Modification Example

Figure 27:
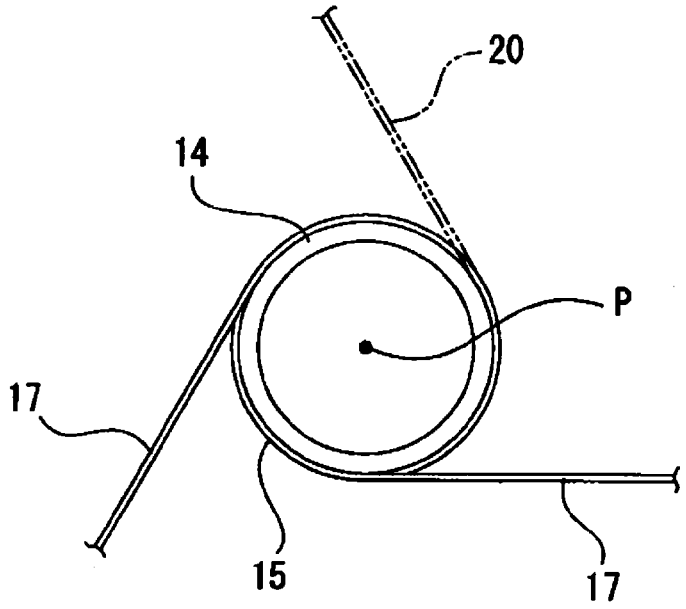
FIG. 27 is an enlarged front view illustrating a second modification example.

In the second modification example, the two leads 17 and a connecting wire 20 are attached to the coil bobbin 14 while being arranged symmetrically with respect to the central axis P of the coil bobbin 14, and the leads 17 and connecting wire 20 are arranged in a linear manner (refer to FIG. 27).

The connecting wire 20 is formed, for example, with the same material as the leads 17 and has its ends connected to the frame 2 and coil bobbin 14. It should be noted that the connecting wire 20 may have the capability of supplying a current to the voice coil 15 as do the leads 17.

Third Modification Example

Figure 28:
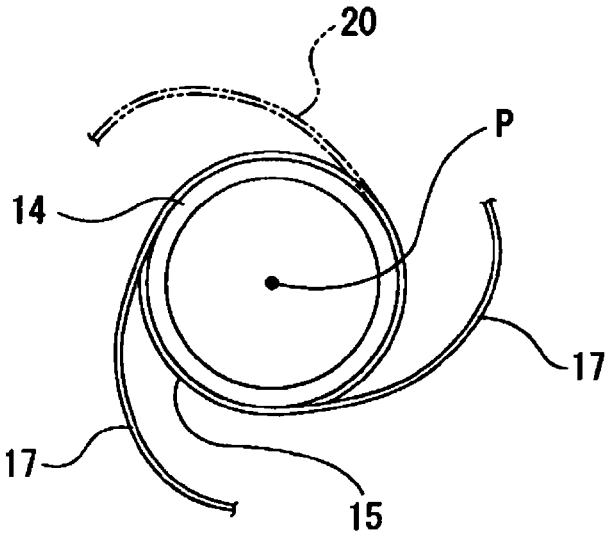
FIG. 28 is an enlarged front view illustrating a third modification example.

In the third modification example, the two leads 17 and one connecting wire 20 are attached to the coil bobbin 14 while being arranged symmetrically with respect to the central axis P of the coil bobbin 14, and the leads 17 and connecting wire 20 are arranged in a curved manner (refer to FIG. 28).

The connecting wire 20 is formed, for example, with the same material as the leads 17 and has its ends connected to the frame 2 and coil bobbin 14. It should be noted that the connecting wire 20 may have the capability of supplying a current to the voice coil 15 as do the leads 17.

Fourth Modification Example

Figure 29:
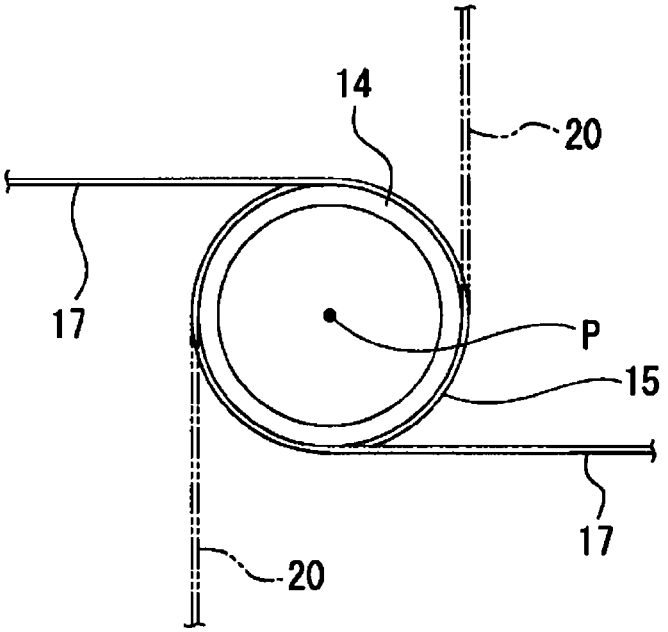
FIG. 29 is an enlarged front view illustrating a fourth modification example.

In the fourth modification example, the two leads 17 and two connecting wires 20 are attached to the coil bobbin 14 while being arranged symmetrically with respect to the central axis P of the coil bobbin 14, and the leads 17 and connecting wires 20 are arranged in a linear manner (refer to FIG. 29).

The connecting wires 20 are formed, for example, with the same material as the leads 17 and have their ends connected to the frame 2 and coil bobbin 14. It should be noted that the connecting wires 20 may have the capability of supplying a current to the voice coil 15 as do the leads 17. Further, the three or more connecting wires 20 may be provided so long as they and the leads 17 are arranged symmetrically with respect to the central axis P of the coil bobbin 14.

Fifth Modification Example

Figure 30:
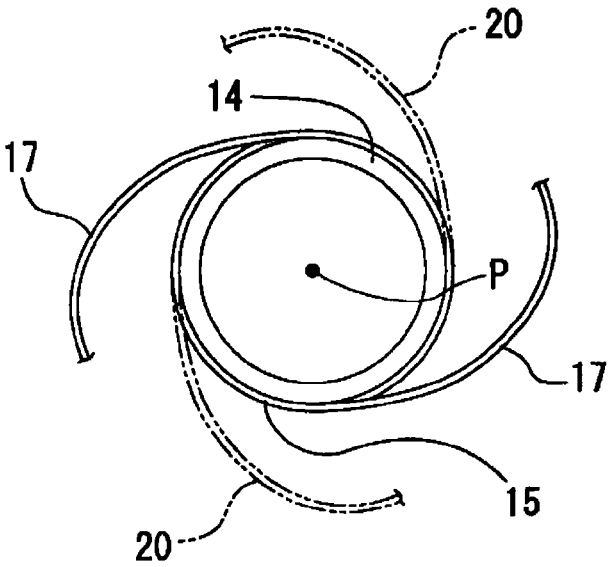
FIG. 30 is an enlarged front view illustrating a fifth modification example.

In the fifth modification example, the two leads 17 and two connecting wires 20 are attached to the coil bobbin 14 while being arranged symmetrically with respect to the central axis P of the coil bobbin 14, and the leads 17 and connecting wires 20 are arranged in a curved manner (refer to FIG. 30).

The connecting wires 20 are formed, for example, with the same material as the leads 17 and have their ends connected to the frame 2 and coil bobbin 14. It should be noted that the connecting wires 20 may have the capability of supplying a current to the voice coil 15 as do the leads 17. Further, the three or more connecting wires 20 may be provided so long as they and the leads 17 are arranged symmetrically with respect to the central axis P of the coil bobbin 14.

If the two leads 17 and at least one connecting wire 20 are arranged symmetrically with respect to the central axis P of the coil bobbin 14 as in the second to fifth modification examples, this prevents the rolling phenomenon of the coil bobbin, thus contributing to further improved quality of the output sound.

[Conclusion]

As described above, in the speaker device 1, the magnetic fluid 16 is filled in the magnetic gap 13. At the same time, magnetic gradients are formed that are adapted to change the magnetic force acting on the magnetic fluid 16 by changing the magnetic flux density in the circumferential direction of the center pole portion 11.

Therefore, the magnetic fluid 16 does not fly off from the magnetic gap 13 during the movement of the coil bobbin 14, and the amount of the magnetic fluid 16 filled in the magnetic gap 13 does not decline. Further, the magnetic fluid 16 is not agitated. This contributes to improved acoustic conversion efficiency and improved sound quality.

Further, magnetic gradients are also formed that are adapted to change the magnetic force acting on the magnetic fluid 16 by changing the magnetic flux density in the axial direction of the center pole portion 11. This contributes to further improved acoustic conversion efficiency and further improved sound quality.

Still further, the minimum magnetic flux density Samin in the circumferential direction is greater than half the highest magnetic flux density Sbmax in the axial direction. This ensures that the magnetic fluid 16 attempting to fly off is positively attracted from the cavities 13*a* to the magnetic gap 13 and held in the same gap 13, positively preventing the magnetic fluid 16 from flying off.

Still further, the saturated magnetic flux of the magnetic fluid 16 is 30 mT to 40 mT, and the viscosity thereof is 300 cp or less. This prevents the magnetic fluid from flying off and ensures that the movement of the coil bobbin 14 is not inhibited by the magnetic fluid 16, thus providing an excellent reproduced sound output from the speaker device 1.

It should be noted that if the magnetic flux change sections 7*a* or 11*a* adapted to form magnetic gradients in the circumferential direction of the center pole portion 11A or 11B are formed on the inner circumferential surface of the plate 7 or 7A or the outer circumferential surface of the center pole portion 11A or 11B, this ensures that the plate 7 or 7A and center pole portion 11A or 11B are not complicated in structure, thus contributing to improved acoustic conversion efficiency and improved sound quality in addition to achieving simplification in structure.

Further, if the magnetic flux change section 12, 12A or 12B adapted to form a magnetic gradient in the axial direction of the center pole portion 11, 11A or 11B is provided on the center pole portion 11, 11A or 11B, or if the magnetic flux change section 12C, 12D or 12E adapted to form a magnetic gradient in the axial direction of the center pole portion 11, 11A or 11B is provided on the plate 7, 7D or 7E, this ensures that the plate 7, 7D or 7E or the center pole portion 11, 11A or 11B is not complicated in structure, thus contributing to improved acoustic conversion efficiency and improved sound quality in addition to achieving simplification in structure.

Still further, if the magnetic flux change section 12, 12A, 12B, 12C, 12D or 12E is provided in such a manner that the front end of the center pole portion 11, 11A or 11B protrudes from the plate 7 in the axial direction or that the front surface of the center pole portion 11 is located backward of the front surface of the plate 7, 7D or 7E, this makes it easy to provide the magnetic flux change section 12, 12A, 12B, 12C, 12D or 12E.

[Present Technology]

It should be noted that the present technology may have the following configurations.

(1) A speaker device including:

a magnet formed in a ring shape;

a yoke having a center pole portion inserted in the center of the magnet;

a plate formed in a ring shape and arranged on the outer circumferential surface of the center pole portion of the yoke while being attached to the magnet;

a coil bobbin formed in a cylindrical shape and movable in the axial direction of the center pole portion while being partially fitted on the center pole portion of the yoke;

a voice coil wrapped around the outer circumferential surface of the coil bobbin, at least part of the voice coil being arranged in a magnetic gap formed between the plate and the center pole portion of the yoke;

a diaphragm having its inner circumferential portion connected to the coil bobbin, the diaphragm being vibrated as the coil bobbin moves; and a magnetic fluid filled in the magnetic gap, in which a magnetic gradient is formed that is adapted to change the magnetic force acting on the magnetic fluid by changing the magnetic flux density in the circumferential direction of the center pole portion.

(2) The speaker device of feature 1, in which a magnetic gradient is formed that is adapted to change the magnetic force acting on the magnetic fluid by changing the magnetic flux density in the axial direction of the center pole portion.

(3) The speaker device of feature 1 or 2, in which the lowest magnetic flux density in the circumferential direction is greater than half the highest magnetic flux density in the axial direction.

(4) The speaker device of any one of features 1 to 3, in which the saturated magnetic flux of the magnetic fluid is 30 mT to 40 mT, and the viscosity thereof is 300 cp or less.

(5) The speaker device of any one of features 1 to 4, in which a magnetic flux change section adapted to form a magnetic gradient in the circumferential direction of the center pole portion is provided on the inner circumferential surface of the plate or the outer circumferential surface of the center pole portion.

(6) The speaker device of any one of features 1 to 5, in which the plurality of magnetic flux change sections are provided to be spaced equidistantly from each other in the circumferential direction.

(7) The speaker device of any one of features 1 to 6, in which a concave portion extending in the axial direction is formed as the magnetic flux change section.

(8) The speaker device of any one of features 1 to 7, in which the magnetic flux change section adapted to form a magnetic gradient in the circumferential direction of the center pole portion is provided on each of the inner circumferential surface of the plate and the outer circumferential surface of the center pole portion.

(9) The speaker device of feature 8, in which the plurality of magnetic flux change sections are provided to be spaced equidistantly from each other in the circumferential direction.

(10) The speaker device of feature 9, in which the plurality of magnetic flux change sections provided on the inner circumferential surface of the plate and the plurality of magnetic flux change sections provided on the outer circumferential surface of the center pole portion alternate in the circumferential direction.

(11) The speaker device of feature 8 or 9, in which a concave portion extending in the axial direction is formed as the magnetic flux change section.

(12) The speaker device of any one of features 2 to 10, in which a magnetic flux change section adapted to form a magnetic gradient in the axial direction of the center pole portion is provided on the plate or center pole portion.

(13) The speaker device of feature 12, in which the tip of the center pole portion protruding in the axial direction from the plate is provided as the magnetic flux change section.

(14) The speaker device of feature 12 or 13, in which a sloping surface sloping with respect to the axial direction is formed on the surface of the plate or center pole portion so that the area where the sloping surface is formed is provided as the magnetic flux change section.

(15) The speaker device of any one of features 12 to 14, in which a curved surface is formed on the surface of the plate or center pole portion so that the area where the curved surface is formed is provided as the magnetic flux change section.

(16) The speaker device of any one of features 2 to 15, in which the magnetic flux change section adapted to form a magnetic gradient in the axial direction of the center pole portion is provided on each of the plate and center pole portion.

(17) The speaker device of feature 16, in which a sloping surface sloping with respect to the axial direction is formed on the surface of each of the plate and center pole portion so that each of the areas where the sloping surface is formed is provided as the magnetic flux change section.

(18) The speaker device of feature 16 or 17, in which a curved surface is formed on the surface of each of the plate and center pole portion so that each of the areas where the curved surface is formed is provided as the magnetic flux change section.

(19) The speaker device of any one of features 1 to 18, in which a plurality of leads are provided for connection to the voice coil, and in which the plurality of leads are arranged symmetrically with respect to the central axis of the coil bobbin.

(20) The speaker device of any one of features 1 to 19, in which a plurality of leads are provided for connection to the voice coil, in which at least one connecting wire is provided for connection to the coil bobbin, and in which the plurality of leads and connecting wire are arranged symmetrically with respect to the central axis of the coil bobbin.

The specific shapes and structures of each of the sections shown in the preferred embodiment are merely examples of embodying the present technology, and should not be construed as limiting the technical scope of the present technology.

It should be understood by those skilled in the art that various modifications, combinations, sub-combinations and alterations may occur depending on design requirements and other factors in so far as they are within the scope of the appended claims or the equivalents thereof.

What is claimed is:

1. A speaker device comprising:

a magnet formed in a ring shape;

a yoke having a center pole portion inserted in the center of the magnet;

a plate formed in a ring shape and arranged on an outer circumferential surface of the center pole portion of the yoke while being attached to the magnet;

a coil bobbin formed in a cylindrical shape and movable in the axial direction of the center pole portion while being partially fitted on the center pole portion of the yoke;

a voice coil wrapped around the outer circumferential surface of the coil bobbin, at least part of the voice coil being arranged in a magnetic gap formed between the plate and the center pole portion of the yoke;

a diaphragm having its inner circumferential portion connected to the coil bobbin, the diaphragm being vibrated as the coil bobbin moves; and a magnetic fluid filled in the magnetic gap, wherein a magnetic gradient is formed that is adapted to change the magnetic force acting on the magnetic fluid by changing the magnetic flux density in the circumferential direction of the center pole portion, wherein a magnetic gradient is formed that is adapted to change the magnetic force acting on the magnetic fluid by changing the magnetic flux density in the axial direction of the center pole portion, wherein a first magnetic flux change section adapted to form a magnetic gradient in the circumferential direction of the center pole portion is provided on an inner circumferential surface of the plate, wherein a second magnetic flux change section adapted to form a magnetic gradient in the axial direction of the center pole portion is provided on the center pole portion, and wherein the lowest magnetic flux density in the circumferential direction is greater than half the highest magnetic flux density in the axial direction.

2. The speaker device of claim 1, wherein a tip of the center pole portion protruding in the axial direction from the plate is provided as the second magnetic flux change section.

3. The speaker device of claim 2, wherein a sloping surface sloping with respect to the axial direction is formed on a surface of the center pole portion so that the area where the sloping surface is formed is provided as the second magnetic flux change section.

4. The speaker device of claim 2, wherein the saturated magnetic flux of the magnetic fluid is 30 mT to 40 mT, and the viscosity thereof is 300 cp or less.

5. The speaker device of claim 2, wherein a plurality of magnetic flux change sections, in which a plurality of the first magnetic flux change sections are provided, are provided to be spaced equidistantly from each other in the circumferential direction.

6. The speaker device of claim 2, wherein a plurality of leads are provided for connection to the voice coil, and wherein the plurality of leads are arranged symmetrically with respect to the central axis of the coil bobbin.

7. The speaker device of claim 2, wherein a plurality of leads are provided for connection to the voice coil, wherein at least one connecting wire is provided for connection to the coil bobbin, and wherein the plurality of leads and the at least one connecting wire are arranged symmetrically with respect to the central axis of the coil bobbin.

8. The speaker device of claim 1, wherein a sloping surface sloping with respect to the axial direction is formed on a surface of the center pole portion so that the area where the sloping surface is formed is provided as the second magnetic flux change section.

9. The speaker device of claim 1, wherein the saturated magnetic flux of the magnetic fluid is 30 mT to 40 mT, and the viscosity thereof is 300 cp or less.

10. The speaker device of claim 1, wherein a plurality of magnetic flux change sections, in which a plurality of the first magnetic flux change sections are provided, are provided to be spaced equidistantly from each other in the circumferential direction.

11. The speaker device of claim 1, wherein a plurality of leads are provided for connection to the voice coil, and wherein the plurality of leads are arranged symmetrically with respect to the central axis of the coil bobbin.

12. The speaker device of claim 1, wherein a plurality of leads are provided for connection to the voice coil, wherein at least one connecting wire is provided for connection to the coil bobbin, and wherein the plurality of leads and the at least one connecting wire are arranged symmetrically with respect to the central axis of the coil bobbin.

* * * * *